US007227519B1

(12) United States Patent
Kawase et al.

(10) Patent No.: US 7,227,519 B1
(45) Date of Patent: Jun. 5, 2007

(54) METHOD OF DRIVING DISPLAY PANEL, LUMINANCE CORRECTION DEVICE FOR DISPLAY PANEL, AND DRIVING DEVICE FOR DISPLAY PANEL

(75) Inventors: Toru Kawase, Katano (JP); Hideo Kurokawa, Katano (JP); Koji Akiyama, Neyagawa (JP); Tetsuya Shiratori, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 145 days.

(21) Appl. No.: 10/089,802

(22) PCT Filed: Oct. 4, 2000

(86) PCT No.: PCT/JP00/06893

§ 371 (c)(1),
(2), (4) Date: Apr. 4, 2002

(87) PCT Pub. No.: WO01/26085

PCT Pub. Date: Apr. 12, 2001

(30) Foreign Application Priority Data

| | | |
|---|---|---|
| Oct. 4, 1999 | (JP) | 11-282765 |
| Nov. 19, 1999 | (JP) | 11-329492 |
| Apr. 4, 2000 | (JP) | 2000-101959 |

(51) Int. Cl.
*G09G 3/30* (2006.01)

(52) U.S. Cl. ..... 345/77

(58) Field of Classification Search ..... 345/74.1, 345/75.1, 75.2, 76, 77, 78, 89, 82, 83, 904; 348/180–189; 324/121 R
See application file for complete search history.

(56) References Cited

U.S. PATENT DOCUMENTS

| | | | | |
|---|---|---|---|---|
| 4,672,275 | A * | 6/1987 | Ando | 315/368.12 |
| 5,619,228 | A * | 4/1997 | Doherty | 345/693 |
| 5,670,985 | A * | 9/1997 | Cappels et al. | 345/601 |
| 5,933,130 | A * | 8/1999 | Wagner | 345/690 |
| 6,023,259 | A * | 2/2000 | Howard et al. | 345/76 |
| 6,025,819 | A * | 2/2000 | Xie et al. | 345/75.1 |
| 6,621,475 | B1 * | 9/2003 | Yamaguchi et al. | 345/74.1 |
| 6,633,301 | B1 * | 10/2003 | Dallas et al. | 345/597 |

(Continued)

FOREIGN PATENT DOCUMENTS

| | | |
|---|---|---|
| JP | 06-236161 | 8/1994 |

(Continued)

*Primary Examiner*—Kevin M. Nguyen
(74) *Attorney, Agent, or Firm*—Steptoe & Johnson LLP

(57) ABSTRACT

In conventional methods of correction luminance in displays, it has been necessary to interrupt video display during use in order to carry out correction. This is a problem in that interruptions are not good for workability from the perspective of the user of the image display device. In consideration of this, the present invention realizes a display without non-uniformity in illumination with respect to both initial characteristics and change over time by measuring anode current of an FED and creating a luminance correction memory. In addition, by illuminating arbitrary pixels during video idle periods, capturing the luminance information from the pixels, and renewing a correction memory based on this luminance information, correction for change over time is possible without interrupting video display. Thus, a display device that can maintain high quality images is provided.

66 Claims, 52 Drawing Sheets

U.S. PATENT DOCUMENTS 6,897,855 B1 * 5/2005 Matthies et al. ..... 345/204

FOREIGN PATENT DOCUMENTS

| | | |
|---|---|---|
| JP | 07-181911 | 7/1995 |
| JP | 07-181916 | 7/1995 |
| JP | 08-030231 | 2/1996 |
| JP | 08-314412 | 11/1996 |
| JP | 09-281925 | 10/1997 |
| JP | 10-031450 | 2/1998 |
| JP | 11-015437 | 1/1999 |
| JP | 11-085104 | 3/1999 |
| JP | 11-015430 | 11/1999 |
| JP | 11-344949 | 12/1999 |

* cited by examiner

Fig. 6

Input Gray Scale Data

| In Decimal | In Binary | | | | | |
|---|---|---|---|---|---|---|
| | A | | B | | | |
| 38 | 1 | 0 | 0 | 1 | 1 | 0 |

(a)

(b)

Luminance Correction Operation

Luminance Correction Operation

Luminance Degradation Characteristics of Phosphors

Luminance Correction Operation

METHOD OF DRIVING DISPLAY PANEL, LUMINANCE CORRECTION DEVICE FOR DISPLAY PANEL, AND DRIVING DEVICE FOR DISPLAY PANEL

TECHNICAL FIELD

The present invention relates to light-emitting elements such as electron-emitting elements and organic EL elements, as well as to display elements that are made up of a plurality of these light-emitting elements. In particular, the present invention relates to a method of driving where luminance variation that arises as a result of change over time is corrected, to a luminance correction device thereof, and to a driving device that utilizes thereof.

BACKGROUND ART

First Background Art

The configuration of a display device that utilizes conventional electron-emitting elements is shown in FIG. 46. In FIG. 46, reference numeral 509 denotes a matrix display panel with a plurality of signal lines and a plurality of scan lines, reference numeral 507 denotes a signal driver for driving the signal lines, reference numeral 508 denotes a scan driver for driving the scan lines, and reference numeral 502 denotes a controller for controlling the signal driver 507 and the scan driver 508. In cases of gray scale driving, data according to the video signals are supplied to the signal driver 507 and a gray scale control function is provided in the signal driver 507.

In the past, two methods have been employed for this system of gray scale control. First, pulse width modulation (hereinafter referred to as PWM) will be explained as one of these methods. An example of the configuration of a signal driver according to this system is shown in FIG. 47 and is described with reference to the figures. In FIG. 47, reference numeral 540 denotes a shift register (abbreviated as S.R.) for determining the timing of the sampling of data signals according to clock and start signals from the controller. Reference numeral 541 denotes a latch that has the function of latching a plurality of signal data lines for indicating gray scale in accordance with the output timing of the S.R. and temporarily storing this data. Reference numeral 542 denotes a decoder for determining the output timing of a PWM based on the data stored in latch 541, and finally, at a PWM circuit 560, pulse width modulated outputs are supplied to the signal lines of the display panel. An example output is shown in FIG. 48. In synchronization with the driving of the scan lines, the pulse width of a constant output is controlled in one horizontal period at a time, outputs ranging from an output of 100% to an output of one LSB, which is the smallest unit, in accordance with the gray scale to be displayed, and gray scale display is thereby carried out.

An example of a configuration of a signal driver for another method, a system of output amplitude modulation, is shown in FIG. 49 and is described with reference to the figure. Parts having the same function as those of FIG. 47 are accorded the same reference numerals, and description is omitted. Reference numeral 543 denotes a D/A circuit for converting data stored in the latch 541 to analog voltages, and these outputs are inputted to an amplifier. Voltages corresponding to output voltages of the D/A 543 are applied to the signal lines of the panel, whereby gray scale display by voltage amplitude modulation in accordance with the data signals is carried out. An example output is shown in FIG. 50. Throughout the effective scanning period of one horizontal period, a constant current ranging from an output of 100% to an output of one LSB, the smallest unit, is driven, whereby gray scale is displayed.

Among the conventional examples described above, PWM is disadvantageous in that the LSB, the smallest unit, is reduced as the number of gray scale levels increases, making what is high-speed operation for a signal driver necessary. For example, in the case of 8-bit 256-level gray scale that is necessary for a nature video on a 640×480 computer display panel, supposing video is displayed at 60 frames/second, an LSB width of 0.12 μs results, thereby necessitating what is extremely challenging high speed operation for a signal driver. Moreover, as the move toward higher resolution progresses, increasingly high speed response will be demanded. Furthermore, the capacitance component that is caused by the wiring, increases, and even if the signal driver does carry out high speed operation, current is lost to parallel capacitance, whereby the phenomenon arises such that light is no longer emitted by the unit of an LSB and precision in gray scale expression is adversely affected.

The other method, the system of output amplitude modulation, is not problematic in terms of high speed operation, but when there are numerous gray scale levels, deviations in the outputs of the signal driver become a problem. For example, in the case of a signal driver having a 100% output of 5 V, the LSB output is 20 mV during 8-bit 256-level gray scale, and it is difficult in terms of both cost and production to ensure this level of accuracy uniformly across all the lines.

In addition, in a display panel in which a plurality of electron-emitting elements is arranged, there is variation in the actual electron-emitting characteristics of each element. This is because it is extremely difficult to make the configuration and process of all the electron-emitting elements exactly the same and because the electron-emitting surfaces are not uniform. As a result, even if the same driving voltage is applied to each of the elements, varying amounts of current are emitted, resulting in the problem of non-uniformity in luminance.

Furthermore, in the case of displaying the same information over a long period (for example, a total illumination time of 3000 hours), the degradation of the elements progresses more in the elements that have been emitting light than in the elements that have not been emitting light. This given display of information is then terminated and subsequently, all of the pixels are illuminated by a same luminance command (for example, a same current value). While all of the pixels should emit light at the same luminance, pixels that had displayed the given display of information have a lower luminance than the other pixels because the degradation of these pixels has progressed further. Thus, differences in luminance arise, resulting in the problem of the appearance of the given information that had been displayed in the form of a phenomenon similar to sticking.

Japanese Unexamined Patent Application 11-15430 is another example from prior art. This application realizes gray scale by combining pulse width control and amplitude control. It has a configuration such that an adder is employed to add the value for pulse width control and the value for amplitude width control. In this configuration, in accordance with the characteristics of the electron-emitting elements, a log amplifier is connected to the output of a PAM circuit, but if a log amplifier is not also connected to the output of a pulse width controller, a problem arises where the log amplifier does not match with the characteristics. In addition, while the characteristics of the electron-emitting elements are taken to be the log characteristics, the actual characteristics of the elements do not precisely align with the straight line defining the log characteristics, and thus variation results. For these reasons, with only a simple log amplifier, it is difficult to output gray scale with accuracy. The configuration of this prior art example is also problematic in that it cannot counter variation in luminance and change over time in the creation of images.

Second Background Art

In the past, image display devices in which, for example, numerous electron-emitting elements are arranged have been subject to variation in luminance as a result of variation in the characteristics of elements. For various image formation devices, high resolution and high quality images have been in demand, and in response to this, various driving methods for suppressing variation in luminance have been proposed.

For example, Japanese Unexamined Patent Publication 7-181911 is a prior art example. In FIG. 51, a representative figure is shown and operation will now be described.

First, the procedure for creating a LUT for correction value data after production and the like of an image formation device is described. At a timing generation circuit 602, various timing signals that correspond to the data creation procedure are generated when LUT creation instruction signals are received. In accordance with these signals, a correction data creation circuit 613 sends a signal so that a PWM/driver circuit 609 generates a drive signal having a specific driving voltage and a specific pulse width for the SCE element of a specific pixel. The element current $I_f$ flowing to the SCE element selected by the drive signal and a signal from a scan driver 612 is detected by a current monitor circuit 610 using monitor resistance, this output is converted to a digital signal by an AD converter, and this signal is sent to a correction data creation circuit 613. This is carried out for all of the SCE elements. The resulting element current data for each of the SCE elements is stored in a current distribution table in a LUT as current distribution data. Focusing on the strong correlation between the electron beam output of the SCE elements and the element current $I_f$ flowing to the elements, the correction method as described below is executed.

Specifically, a monitored element current and element current data stored in the correction data creation unit 613 corresponding to the given element are compared such that if the difference is within a specified range, a value is designated as an acceptable value and if not, it is judged that correction is necessary. When correction is necessary, $I_f$ correction data for the monitored pixel is created and written to a LUT 606. Note that, in the initial state, $I_f$ correction data is set so that none of the pixels require correction. Element current data also is set to a same value in all of the pixels. In this manner, when $I_f$ correction data is written to the LUT 606, a video signal is corrected using this data, and the monitoring and evaluating of this same pixel, i.e., the pixel reset by the $I_f$ correction data, is repeated until an acceptable value is reached.

When it is determined that the element current $I_f$ has reached an acceptable value, the element current data is renewed with this element current. This process is carried out on all of the elements, after which the process is terminated. In this manner, input video signals are corrected, making correction of variation in luminance possible.

By repeating the measurement of the current distribution data as described above according to necessity, it is possible to effectively carry out the correction of not only variation in the initial characteristics of the SCE elements but also of changes in characteristics over time. Carrying out driving as described above using correction values stored in the distribution correction table makes it possible to realize a high quality video display without luminance variation.

In the prior art example described above, a correction operation that adjusts for change over time is carried out as follows. In order to detect the change in the characteristics of the elements over time, after a suitable amount of time has passed, the element current $I_f$ of each of the pixels is measured and this value is compared to the initial value for element current stored in the current distribution table in the LUT. In cases where the difference between the measured value and the initial value is equal to or greater than a specified value, it is judged that there has been a change in the characteristics of the element over time, and test driving is carried out in the same manner as was done initially to correct the correction values in the correction table.

Because this correction is carried out sequentially on all of the pixels, a certain amount of time is required and the problem of having to interrupt video display during the correction operation arises.

For example, suppose that resolution is VGA (640×480), frame rate 60 Hz, and video display carried out by line-sequential scanning. In this case, if measurement of the luminance of each pixel is carried out in the same cycle as display operation, the time required for measurement is $640\times480\times1/60\times1/480=10.7$ (sec). Because convergence to a given deviation or less is not realized with one correction, it is necessary to repeat correction. For example, if convergence to the value for deviation or less is realized by carrying out the correction 5 times, 54 seconds are required in total. In order to carry out the correction, it is necessary to interrupt video display during use, and this time cannot be ignored or permitted.

Ideally, a display device that does not require correction operation is desired, because having to perform correction operations is not good for workability from the perspective of the user of the image display device and because it contributes to lower quality display.

Third Background Art

There is also a prior art example that adopts, as a system of gray scale realization, a system of gray scale control where output amplitude control and output pulse width control are carried out simultaneously. This prior art example describes a system for realizing high gray scale resolution without requiring high speed and high accuracy. However, problems sometimes arise in display at low luminance levels.

This method is described using FIG. 52. FIG. 52(*a*) shows an example where pulse width is divided into 16 and amplitude value divided into 4 to realize a total of 64 levels of grays scale. In this case, the elements of the display panel are made of organic EL or the like, and when tending toward low luminance, i.e., when the value for gray scale is small and the pulse width value small, the response speed sometimes slows down drastically (FIG. 52(*b*)). In, for example, an organic EL element, it has been confirmed that response speed slows when a near threshold voltage is applied to realize low luminance. For this reason, even if the number of divisions of pulse width is reduced and constrain on response speed alleviated, because the amplitude value (applied voltage) is small, the problem arises where response speed slows down to an even greater degree.

DISCLOSURE OF THE INVENTION

It is an object of the present invention to overcome the foregoing problems by providing a driving method for a display panel, a luminance correction device for a display panel, and a driving device for a display panel, each of which are primarily intended for the realization of a display in which non-uniformity in illumination does not arise with change over time.

In order to achieve the above objects, the present invention adopts the following driving method for luminance correction.

(1) A luminance setting reference value is changed with the elapsing of time. Strain on elements is thereby alleviated and operating life extended.

(2) The renewal intervals for correction memory are changed in accordance with the characteristics of luminance degradation. This makes recorrection at optimum intervals possible without relying on luminance measurement and evaluation.

(3) In a device having phosphors, the degradation characteristics of the phosphors is considered in the carrying out of the luminance correction.

(4) Correction operation (driving of pixel and capturing of luminance information) is carried out within a period that does not affect video signal output. The need to interrupt video display during use is thereby eliminated.

(5) Gray scale is realized in particular by a system of carrying out amplitude control and pulse width control simultaneously, by a system of changing amplitude value in the direction of increase in order to display gray scale, by control of switching between systems of gray scale, and the like. Realization of high gray scale resolution and output of high quality images is thereby made possible.

Specific configurations of the present invention will be described below.

An embodiment of a method of driving a display panel according to the present invention comprises carrying out luminance setting operations such that luminance is set two or more times and to a different luminance setting value each time, so that the set luminance is changed with the elapsing of driving time.

According to the above configuration, because the luminance setting value used during recorrection of luminance is changed with the elapsing of driving time, excessive driving of individual pixels is prevented and operating life of the elements thus extended.

The luminance setting values may be determined from measured luminance information, and luminance corrected so as to match with the determined luminance setting values.

In addition, the present invention, as a specific luminance correction operation, may be applied to a method of driving a display panel wherein pixels are driven, luminance information is captured from the pixels, correction values are calculated from the measured luminance information and a luminance setting value, the correction values are stored in the correction memory, and driving amount is corrected in accordance with the correction memory.

It is preferable that each of the luminance setting values not exceed a preceding luminance setting value.

Another embodiment of a method of driving a display panel of the present invention comprises carrying out luminance correcting operations such that luminance is corrected two or more times at predetermined intervals and each of the intervals between the luminance correction operations differ, whereby the starting interval of recorrection operation is varied.

According to the above configuration, optimum correction intervals according to element characteristics can be ensured.

In particular, it is preferable that the intervals between the luminance correction operations be varied according to the luminance degradation characteristics of display elements.

A series of renewal operations on the correction memory may be carried out at specified intervals or repeated continuously.

It is preferable that the luminance correction operations be carried out during periods other than image output periods. Thus, the necessity of interrupting video display during use is eliminated.

Specifically, the operations for capturing luminance information from the pixels may comprise at least illuminating the pixels during periods other than video output.

It is preferable that the periods other than video output periods be vertical blanking periods, and luminance information from a given number of grouped pixels be captured during each of these periods. Because vertical blanking periods are sufficiently long in comparison to horizontal blanking periods, the luminance information from a given number of grouped pixels can be captured.

It is preferable that adjacent pixels not be successively driving. When adjacent pixels are successively driven, even though the period of illumination is short, the illumination is linear and depending on the timing, the illumination is sometimes perceived as a line. In order to overcome such a problem, adjacent pixels are not successively driven.

Another embodiment of a driving method of a display panel of the present invention is such that the correction value calculations are carried out using both measured luminance information and degradation characteristics related to either the luminance of elements for which luminance has been measured or to the luminance of pixels for which luminance has been measured.

According to the above configuration, highly accurate luminance correction is possible.

In particular, when the display panel has a light-emitting surface with phosphors, instead of degradation characteristics related to either the luminance of the elements or the luminance of the pixels, degradation characteristics related to the luminance of the phosphors may be used.

The degradation characteristics may be measured in advance, rates of degradation calculated based on the driving integral amount of every pixel, correction values calculated using both the measured luminance information and the rates of degradation, and the correction memory renewed.

The correction operations may be repeated continuously until the difference between the measured luminance information and the luminance setting value reaches a fixed value or less.

For the captured luminance information, driving current or the starting point of the illumination of pixels may be used.

When the display panel has at least an anode electrode and a light-emitting surface having a plurality of phosphors on the anode electrode, the captured luminance information may be anode current.

Another embodiment of a method of driving a display panel according to the present invention comprises in an initial stage after fabrication of the panel, illuminating all of pixels in the panel one at a time, capturing luminance information from the pixels, setting luminance two or more times and to a different luminance setting value each time, calculating correction values from the captured luminance information and the luminance setting value, and storing the correction values in a correction value memory as initial correction values. As described above, correction may be carried out using initial values.

For correction, input luminance signals may be corrected in accordance with the correction values stored in the correction memory or the amplitude value or the pulse width of driving signals applied to the display panel may be corrected in accordance with the correction values stored in the correction memory. In addition, the correction values are sometimes calculated so as to incorporate data for γ correction for each pixel and stored to the correction memory.

In a method of driving a display panel according to the present invention, a gray scale realization method for the display panel may be either amplitude control or pulse width control. It is preferable that except when an output is completed, a current or voltage value for amplitude control be changed only in the direction of increase.

A gray scale realization method for the display panel is sometimes a system of driving such that amplitude control and pulse width control are carried out simultaneously. Specifically, it is preferable that for the gray scale control, the amplitude control be such that using m high-order bits of gray scale data represented by n bits, where m and n are arbitrary integers, a current or voltage value controlled by amplitude is outputted at intervals of $1/2^m$ maximum value and the pulse width control be such that using (n-m) low-order bits, pulse width is controlled at intervals of $1/2^{(n-m)}$ maximum value.

The LSB of current or voltage value output may be outputted twice, or the LSB or output pulse width outputted twice, or the LSB of both outputted twice.

The number of divisions of output for pulse width control may be greater than the number of divisions of output for amplitude control In a method of driving a display panel, a gray scale realization method of the display panel is sometimes a driving method for realizing gray scale comprising switching between amplitude control or pulse width control and a system of gray scale control in which amplitude control and pulse width control are carried out simultaneously.

Specifically, it is preferable that, when the luminance signal level to be outputted is equal to or less than a reference value, amplitude control or pulse width control be carried out, and when equal to or greater than a reference value, the system of gray scale control where amplitude control and pulse width control are carried out simultaneously be carried out to realize gray scale.

The reference value is sometimes a number of output gray scale levels and is set to be the number of gray scale levels on the pulse width control side in the system of gray scale control where amplitude control and pulse width control are carried out simultaneously.

The gray scale realization system is sometimes switched according to time to realize gray scale.

In addition, other embodiments of the present invention include luminance correction devices and driving devices for actually realizing the methods of driving a display panel described above.

BRIEF DESCRIPTION OF THE DRAWINGS

FIG. 6 is a table showing the decoder input data of embodiment 1 of the present invention.

BEST MODE FOR CARRYING OUT THE INVENTION

Embodiment 1

Basic Driving Operation of the Present Invention

Figure 1:
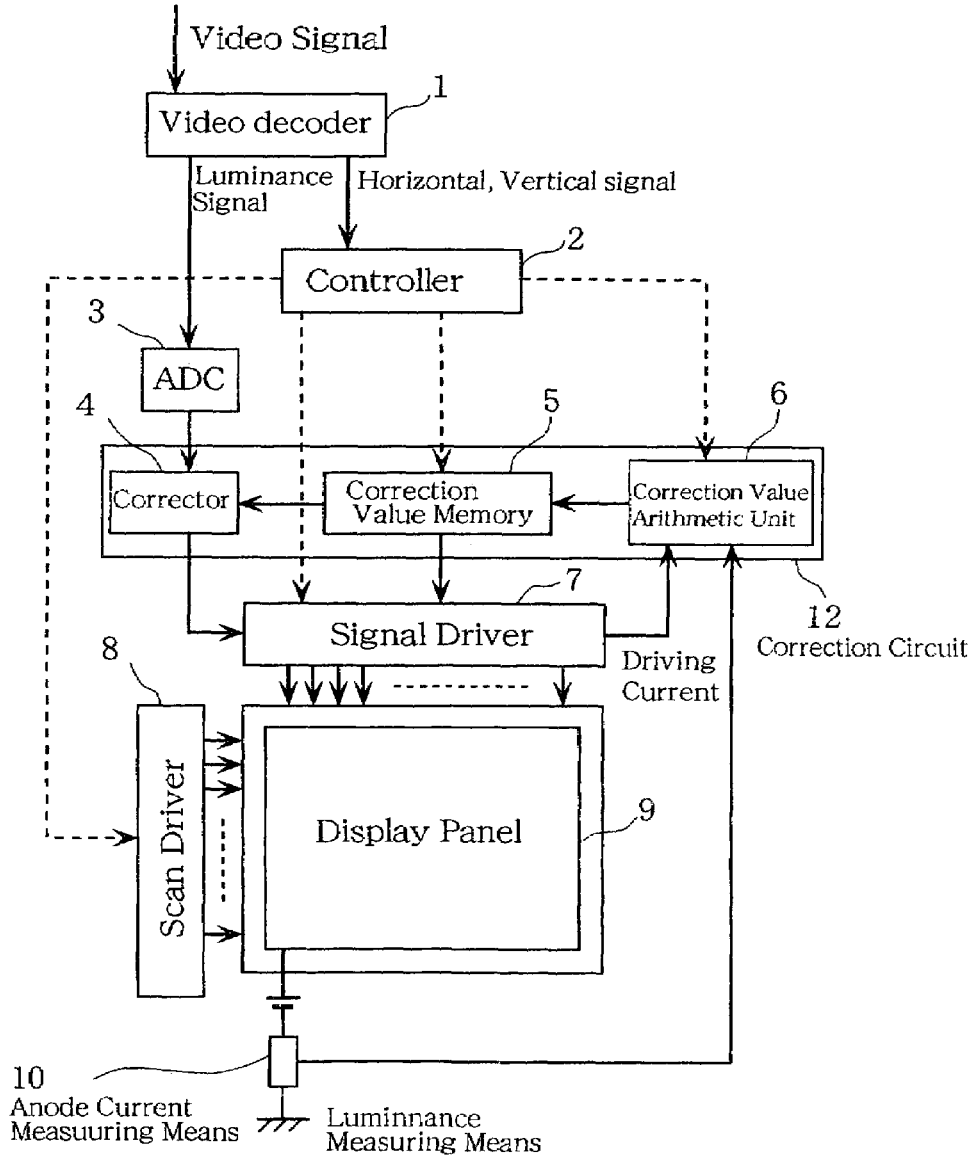
FIG. 1 is a diagram showing the operational principle of embodiment 1 of the present invention.

The operational principle of the present invention is shown in FIG. 1 and is described with reference to the figure.

Reference numeral 9 denotes a display panel in which numerous, for example, electron-emitting elements are arranged in rows and columns. Display panel electrodes for data input and display panel electrodes for scan signal input are each connected to a driver. Reference numeral 8 denotes a scan driver that sequentially scans, one row at a time, the panel wired in rows and columns. For example, in the scan driver, there is a switching circuit for each row, and the scan driver has a function such that in accordance with the timing of the scanning, only a given selected row is connected to either a direct current voltage source Vy (not shown in figure) or 0 V, while other rows are connected to the other voltage value. Reference numeral 7 denotes a signal driver that applies modulated signals to control the emitting of light from each element. The signal driver 7 receives, for example, luminance signals (gray scale signals) created from video signals and the like and applies a voltage (or current) value in accordance with each gray scale signal to each of the pixels. The signal driver 7 has a shift register, a latch circuit, and the like and converts a time series of luminance signals to parallel data corresponding to each pixel. A voltage (or current) value in accordance with a gray scale signal is applied to each of the pixels. In each pixel of a panel made up of, for example, electron-emitting elements, electrons are emitted in response to a gray scale signal causing the phosphors to emit light. Pixels emit light in response to luminance signals in each selected row and sequential driving is carried out by the scan driver, whereby a two-dimensional image is created.

The flow of inputted video signals will now be explained. Inputted signals are represented here by video signals, but other signals may be used as long as the signals display an image. An inputted composite video signal is separated into an RGB luminance signal and horizontal and vertical signals by a video decoder 1. The RGB luminance signal is converted to digital by an A/D converter 3. A controller 2 receives the horizontal and vertical signals from the video decoder 1 and generates timing signals that are synchronized with the horizontal and vertical signals.

A correction circuit 12 will now be explained. In order to suppress variation in luminance between the pixels, a value related to luminance is measured by a luminance measuring means. Reference numeral 10 denotes an anode current measuring means. When a display panel is made up of electron-emitting elements, it is desirable that phosphors and an anode electrode be disposed on a surface opposing the electron-emitting elements and that current emitted from each of the pixels be determined by measuring the amount of current flowing to this anode electrode. For example, supposing a measuring resistor is disposed in series between the anode source and GND (common potential), it is possible to detect the amount of current emitted in the form of a voltage value. In addition, the driving current signal from the signal driver 7 is a detected driving signal applied to the display panel. Using either of these values related to luminance, a correction value is calculated. A correction value arithmetic unit 6 performs comparison operations between values related to measured luminance and target luminance values to determine amounts of difference or the like and stores correction values for each pixel to reach a target luminance to the correction value memory 5. A corrector 4 retrieves, from the correction value memory 5, the correction values corresponding to pixel positions for driving a time series of inputted luminance signals and carries out correction. Signals that have been corrected are supplied to the signal driver.

In this manner, gray scale signals are corrected according to the luminance characteristics of each pixel. In addition, luminance correction may be carried out such that a decoder in the signal driver 7 (not shown in figure) uses the correction value memory.

The operation of each of the elements will be explained below.

Configuration of Display Panel

Figure 2:
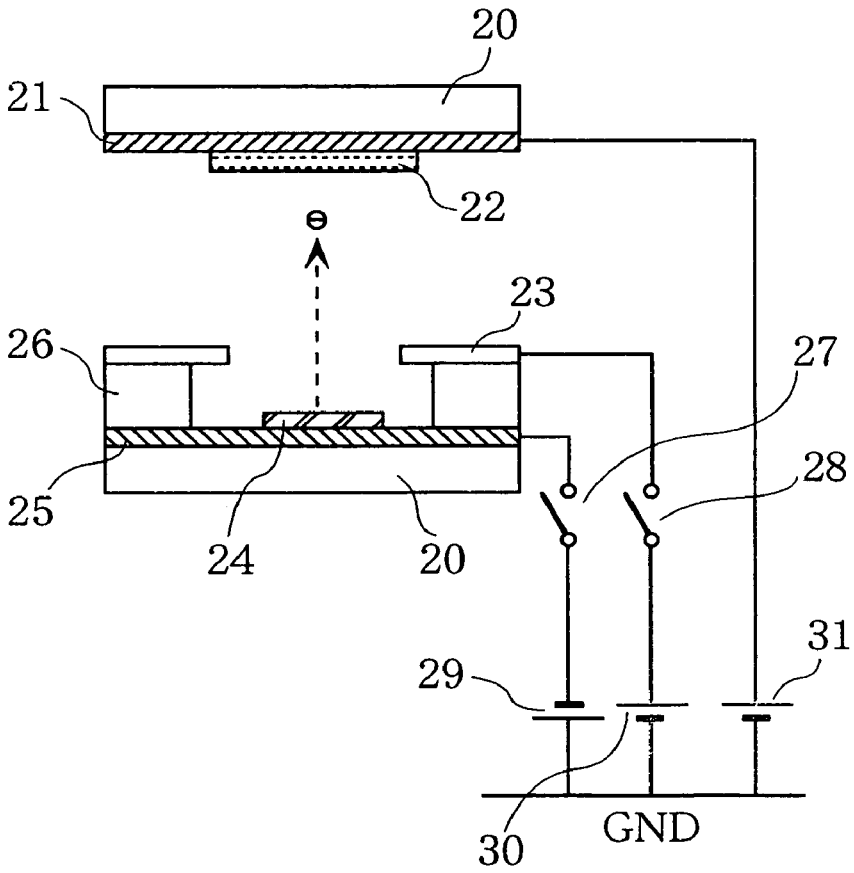
FIG. 2 is one example of a display panel of embodiment 1 of the present invention.

The display panel 9 is made up of a plurality of elements and will be described using, for example, electron-emitting elements as shown in FIG. 2.

In FIG. 2, reference numeral 20 denotes a glass substrate, and a cathode electrode 25 is formed on the upper side of the glass substrate. Reference numeral 24 denotes an electron-emitting element that is composed of a material that easily emits electrons such as a carbon-based material, specifically, carbon nanotube, graphite, diamond, or the like. In addition, silicon, whisker (zinc oxide whisker), or the like may be used. Extraction electrodes 23 are formed so as to sandwich an insulating layer 26, and electrons are emitted from the electron-emitting element 24 when a voltage having a greater value than a certain value is applied between the cathode electrode 25 and the extraction electrodes 23. Reference numeral 21 denotes an anode electrode that causes emitted electrons to accelerate and collide with the phosphors 21. The phosphors generate light of R, G, and B, respectively. Reference numeral 31 denotes an anode source, reference numeral 29 a cathode source, and reference numeral 30 an extraction source. Such electron-emitting elements are arranged in rows and columns. For example, when gate electrodes 23 serve in a row, gate switches 28 take on the function of a scan driver such that the row electrodes are sequentially connected to sources 30. The cathode electrodes 25 are in columns and cathode switches 27 take on the function of the signal driver 7, whereby switching between ON and OFF is effected by data such as video signals.

Figure 3:
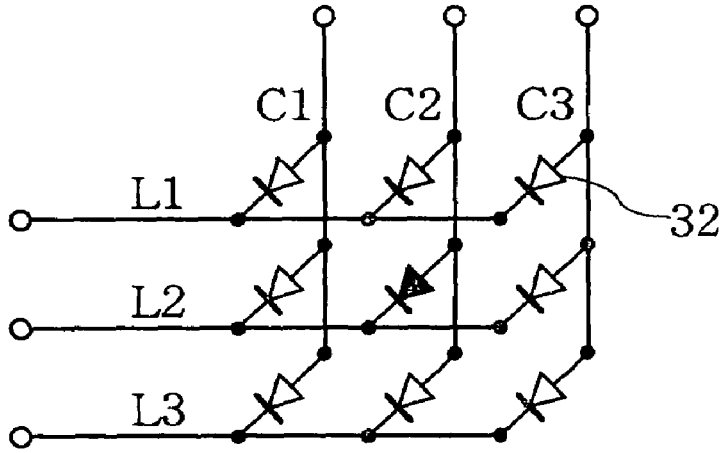
FIG. 3 is a circuit diagram of a display panel of embodiment 1 of the present invention.

Alternatively, when the display panel 9 is made up of organic EL elements, equivalent circuits are as shown in FIG. 3. The equivalent circuit of an organic EL element may be represented as a diode 32. Such organic EL elements are arranged in rows and columns to form the display panel 9. Electrodes C1–C3 are connected to the signal driver 7 and L1–L3 are connected to the scan driver 8 to carry out driving.

While not shown in the figure, LED elements, which can be represented by the organic EL equivalent circuits, may be used for the display panel.

Operation of Gray Scale Control Circuit

The principle of gray scale control operation of the present invention will be described with reference to the figures.

Figure 4:
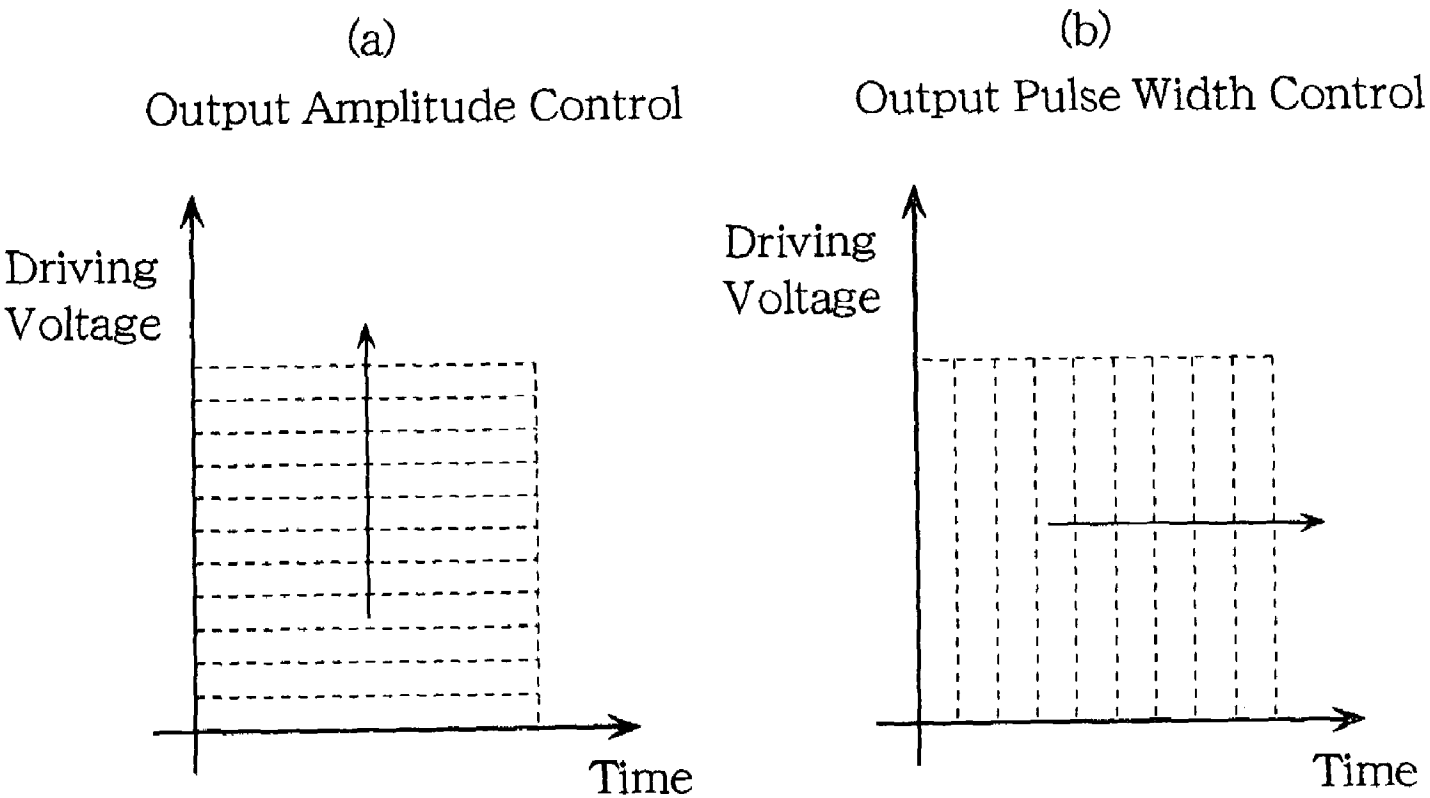
FIGS. 4(*a*) and 4(*b*) are diagrams each showing an example of an output waveform of embodiment 1 of the present invention.

The signal driver 7 has the function of outputting gray scale information to the display panel in accordance with video signals. FIG. 4 shows gray scale output operation, there being mainly two systems that are commonly employed. FIG. 4(*a*) shows output amplitude control where the driving time for a pixel is constant and amplitude value is changed in accordance to video information. FIG. 4(*b*) shows output pulse width control where the amplitude value is constant and the pulse width is changed in accordance to video information. The signal driver supplies gray scale information to the display panel using the systems described above.

In addition, another gray scale realization means is a system disclosed by the present inventors (Japanese Patent Application 11-107935). This system of gray scale realization makes a display with high gray scale resolution possible, without necessitating high-speed response of the elements and the driver circuits or high precision amplitude control. Specifically, the system is such that output amplitude control and output pulse width control are combined to carry out output.

Figure 5:
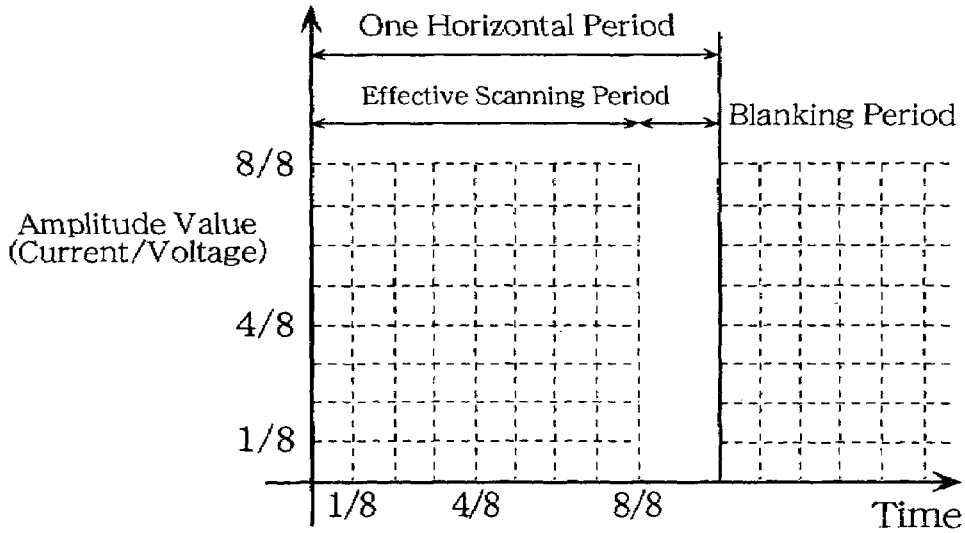
FIG. 5 is a diagram of one example of an output waveform of embodiment 1 of the present invention.

FIG. 5 is a diagram showing the principle of operation. In the amplitude value direction, 8 values for gray scale are taken at regular intervals and in the time direction also, 8 values for gray scale are taken at regular intervals. By combining these values for gray scale, the system realizes 8×8=64 levels of gray scale. A method of division into time direction and amplitude value (current or voltage) direction has been described, but various other methods are possible depending on types of decoding, so it is desirable to select a method according to the characteristics of the light-emitting elements. For example, it is acceptable to take values proportional to a power of 2 for the amplitude value direction and values proportional to a power of 2 also for the time direction.

Note that the number of divisions is not limited to that shown in the figure, and it is possible to take an arbitrary number for the number of divisions. In addition, the output period need not be continuous, it being possible to output discontinuously. Furthermore, control may be carried with an additional LSB unit added to output.

A specific method of distribution will now be described. The distribution of voltage value and pulse width can be freely set, but as an example, consider distribution in equal divisions. Input data is divided into n high-order bits and m low-order bits to realize gray scale. For example, consider the case of realizing 6 bit gray scale (64 gray scale levels), the bits being distributed such that 2 bits are allotted to voltage value (4 gray scale levels) and 4 bits to pulse width (16 gray scale levels). The decode algorithm is as follows. First, 2 high-order bits and 4 low-order bits of input data are latched as voltage value division data [A] and pulse width division data [B], respectively. Next, a voltage value for the numerical value of the data [A] is outputted over a period of 16 intervals. At the same time, output is such that for only the number of intervals corresponding to the numerical value of data [B], 1 is added to the voltage value output.

This is described with reference to FIG. 5 and FIG. 6. For example, input data is taken to be 38/64 gray scale. In binary form, this is represented by [100110]. Voltage value division data [A]=2[10] and pulse width division data [B]=6[110]. The output waveform is such that the numerical value of the data [A], 2, is outputted over a period of 16 intervals. At the same time, for the number of intervals corresponding to the numerical value of the data [B], 6, a value of 3 is outputted, 1 having been added to the output.

Figure 7:
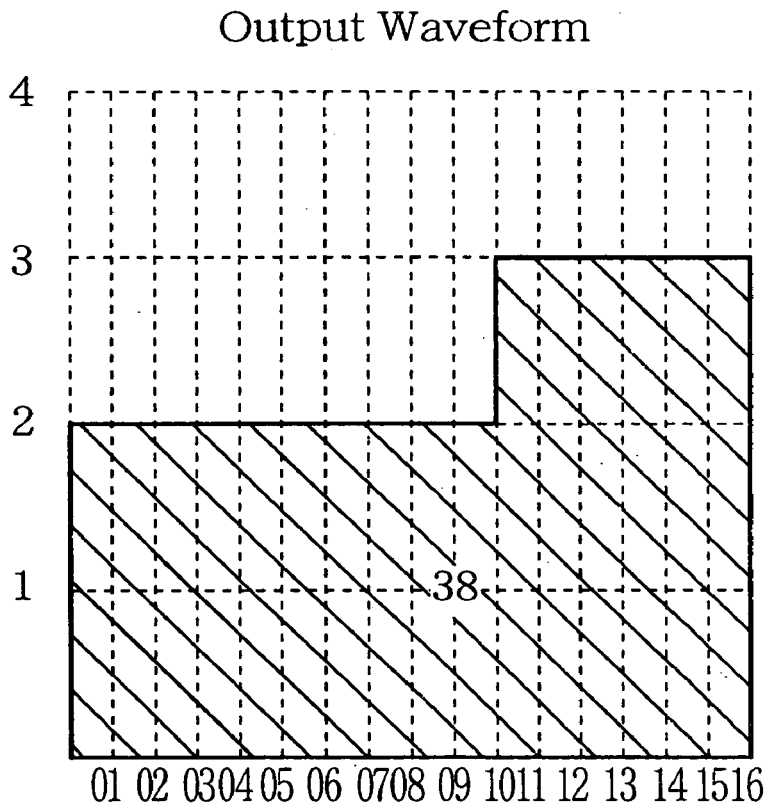
FIG. 7 is a diagram showing one example of an output waveform of embodiment 1 of the present invention.

Consequently, as the voltage value output, the waveform shown in FIG. 7 results, it being thought that gray scale is realized by stacking blocks that are the smallest unit of voltage value output.

Thus, because it is thought that the blocks of voltage output are stacked, there is the advantage of being able to arbitrarily change the distribution and the number of divisions. In other words, in the case of changing the division of voltage and pulse width so that there are 16 divisions for voltage and 4 divisions for pulse width, it is only necessary to change the number of bits of data latched for each. The number of divisions and distribution may be determined in accordance with the characteristics of the light-emitting elements.

Figure 8:
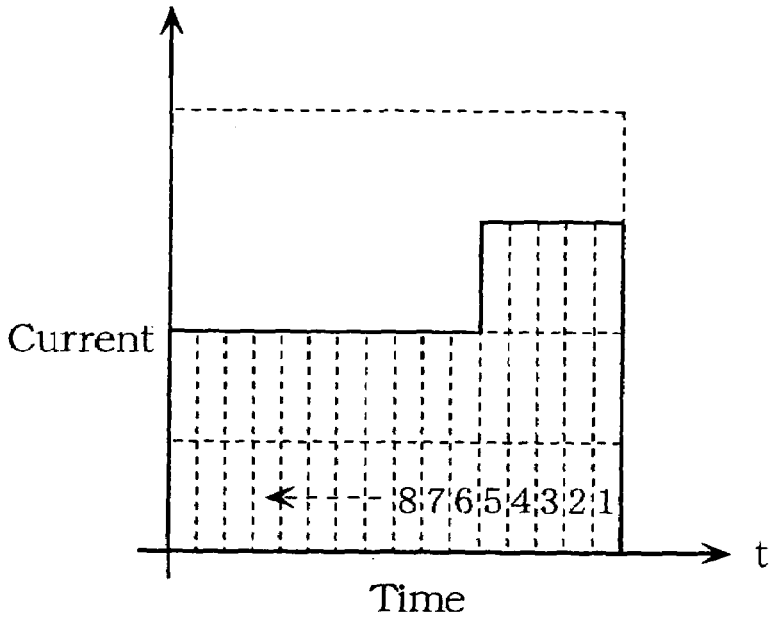
FIGS. 8(*a*) and 8(*b*) are each diagrams showing one example of an output waveform of embodiment 1 of the present invention.
Figure 8:
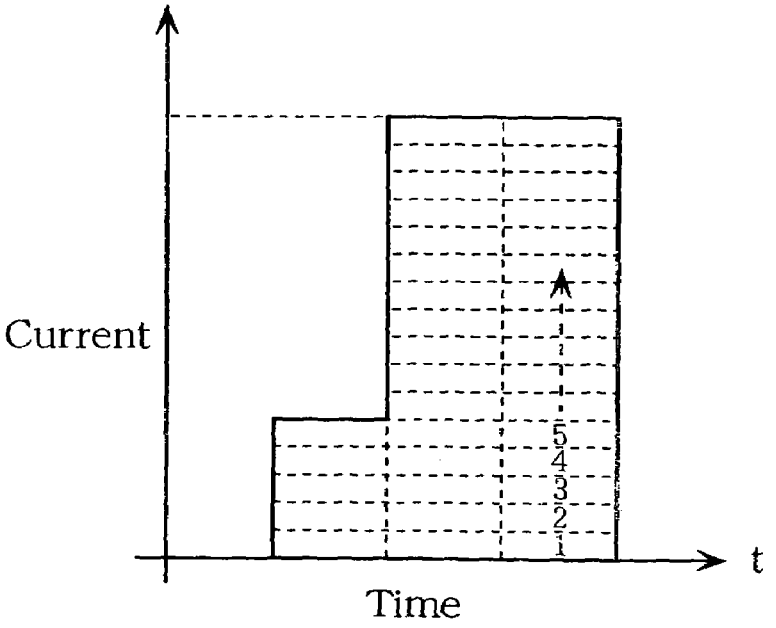

The outputs shown in FIGS. 8(*a*) and 8(*b*) also are acceptable as methods of distribution and decode algorithms. These figures, as is also the case with FIG. 7, are such that there is change only in the direction of increase in amplitude.

In cases where elements to be driven have an equivalent capacitance component, a certain amount of voltage is charged to the equivalent capacitor in accordance with driving amplitude. Because a circuit for reducing current is not provided in a simple driver circuit, it is not possible to lower the voltage of the charged equivalent capacitor even if driving where amplitude is reduced is attempted. For this reason, a method of changing amplitude is employed. Specifically, because it is possible to change the voltage of the equivalent capacitor in the direction of charging, as shown in FIG. 8, driving is carried out where the current command value is changed only in the direction of increase.

Thus, by changing the current command value only in the direction of increase in accordance with the characteristics of the connected panel, it is possible to output gray scale with good accuracy.

Note that the distribution methods and decode algorithms are not limited to those described above, as is the case with numerical values for the number of distributions, the number of gray scale levels, and the like. In addition, output is not limited to a voltage value, it being possible to use a current output or to attach a constant current circuit in accordance with the panel to be driven.

As described above, by combining amplitude control and pulse width control to carry out output, display with high grade scale resolution is made possible, without necessitating high-speed response of elements and driver circuits or high precision amplitude control. In particular, in the case of a display element that employs electron-emitting elements, response speed is higher than that of a liquid crystal element, but because realization of gray scale with common PWM becomes an impossibility as resolution improves, this system of grays scale driving has the potential for being an effective means with high resolution panels.

An example of a configuration of a display panel will now be described with reference to the figures.

Figure 9:
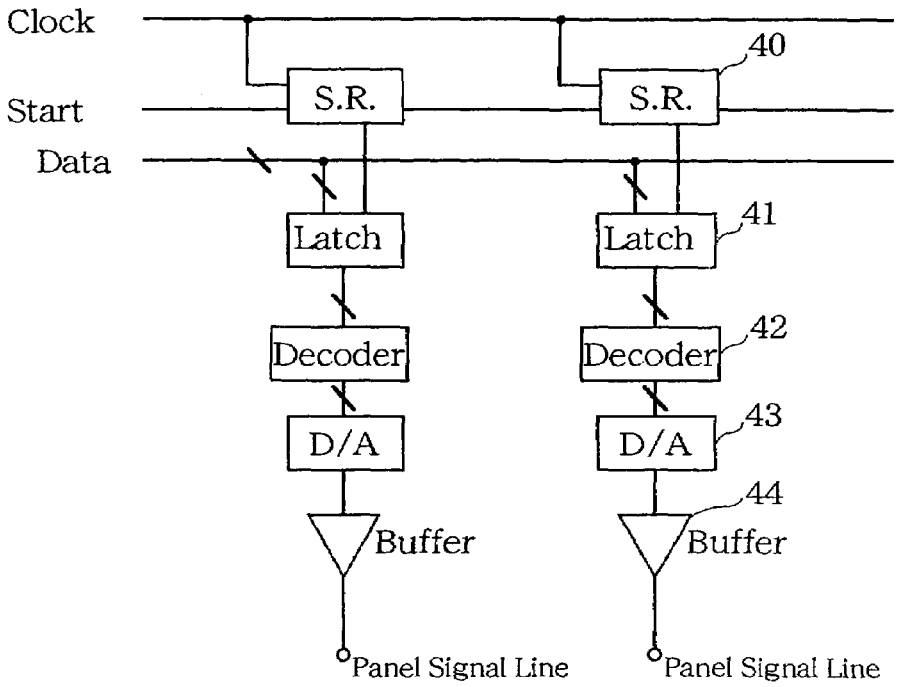
FIG. 9 is a diagram showing the configuration of a display driver of embodiment 1 of the present invention.

In FIG. 9, reference numeral 40 denotes a shift register (abbreviated as S.R.) for determining the timing of the sampling of data signals according to clock and start signals from the controller.

Reference numeral 41 denotes a latch that has the function of latching a plurality of signal data lines for indicating gray scale in accordance with the output timing of the S.R. and temporarily storing this data.

The latched data is converted into output values by a decoder 42 in accordance with a system of gray scale.

In the case of output pulse width control, the decoder 42 determines the output timing of pulse width based on data stored in the latch 41. In the case of output amplitude control, if the data stored in the latch 41 is not corrected, the data is supplied, unaltered, to a D/A converter.

In the case of a system of gray scale where amplitude control and pulse width control are combined to carry out output, the decoder 42 decodes the data into two types of data, that in the time direction and that in the voltage output direction. This system of control will now be described in detail. The system is such that the output voltage value is changed in accordance with progression along the time axis in an effective scanning period. For this reason, output data from the decoder, in other words, the voltage command value is 1 system and is supplied to a D/A converter 43. The voltage command value converted by the D/A converter is supplied to the buffer circuit. The buffer circuit may be a common amplifier, but in the case of driving, for example, electron-emitting elements, it functions such that signal voltages are boosted to driving voltages.

In order that the decoder 42 be able to effectively carrying out the distribution of current value and pulse width, it is suitable to employ a FPGA (Field Programmable Gate Array) or a CPLD (Complex Programmable Logic Device). In these types of ICs, a software program is created, and functions are realized by downloading the program to the IC. In other words, programming the distribution of voltage value and pulse width according to the characteristics of the connected panel is possible, in turn making accurate output of gray scale possible.

In addition, because it is possible to program the decoder according to the characteristics of the connected panel, the distribution of and the number of divisions of amplitude (voltage, current) and pulse width can be arbitrarily changed, making accurate output of gray scale possible. Note that because the distribution and the number of divisions are determined once the characteristics of the panel have been determined, it is suitable to fabricate an IC including an integrally formed decoder.

In addition to or in place of the systems of gray scale described above including amplitude control, pulse width control, and a system of gray scale where amplitude control and pulse width control are combined to carry out output, systems of control such as error diffusion control or a dither method may be employed as systems of improving gray scale resolution.

Configuration and Construction of Luminance Capturing Means

Configuration 1 for Luminance Capturing Means

Figure 10:
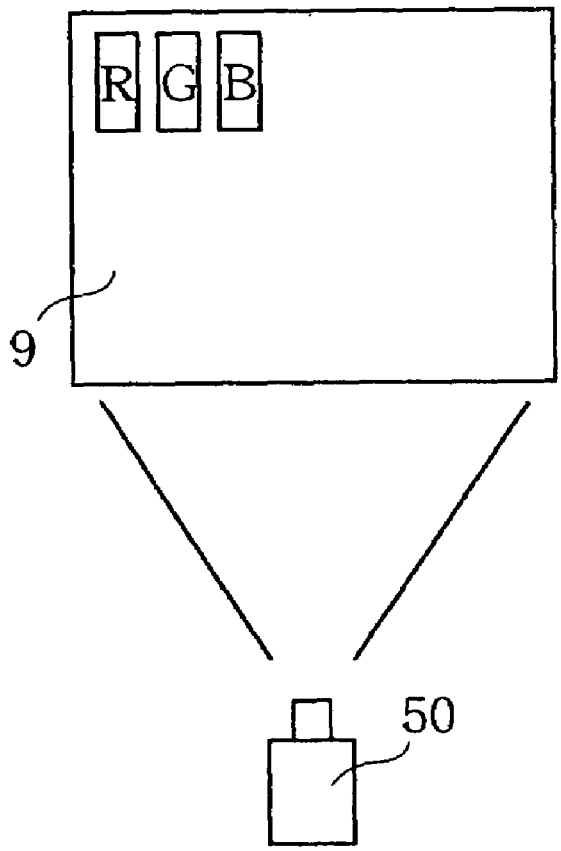
FIG. 10 is a diagram for illustrating the operation of capturing luminance when a CCD is used as the means of capturing luminance.

For a device that captures luminance, a CCD is commonly used. In cases where at the shipping stage of an image evaluation device or the like, luminance is captured for initial correction, a CCD may be used. A case of using a CCD for the luminance capturing means will now be explained with reference to FIG. 10. The display panel 9 has pixels made up of R, G, and B subpixels. For example, with VGA resolution, there are 640 pixels, 640×3 subpixels, horizontally, and 480 pixels, vertically. Luminance from the display panel 9 is measured by a CCD 50. The resolution of the display panel 9 and the resolution of the CCD 50 correspond, and supposing the alignment is correct, the unaltered information captured by the CCD becomes the luminance information from the RGB subpixels. If luminance information from the RGB subpixels is sent to the correction arithmetic unit 6, a correction value for each subpixel is calculated and stored in the correction value table 5.

In such cases where alignment is difficult, the resolution of the CCD 50 is lower than the resolution of the display panel 9, RGB subpixels of the display panel 9 may be turned on sequentially and the pixel information of the subpixels measured sequentially.

Figure 11:
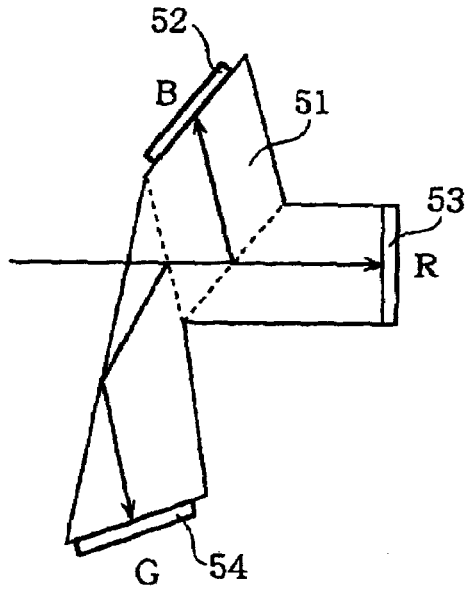
FIG. 11 is a diagram showing another configuration when CCDs are used as the means of capturing luminance.
Figure 12:
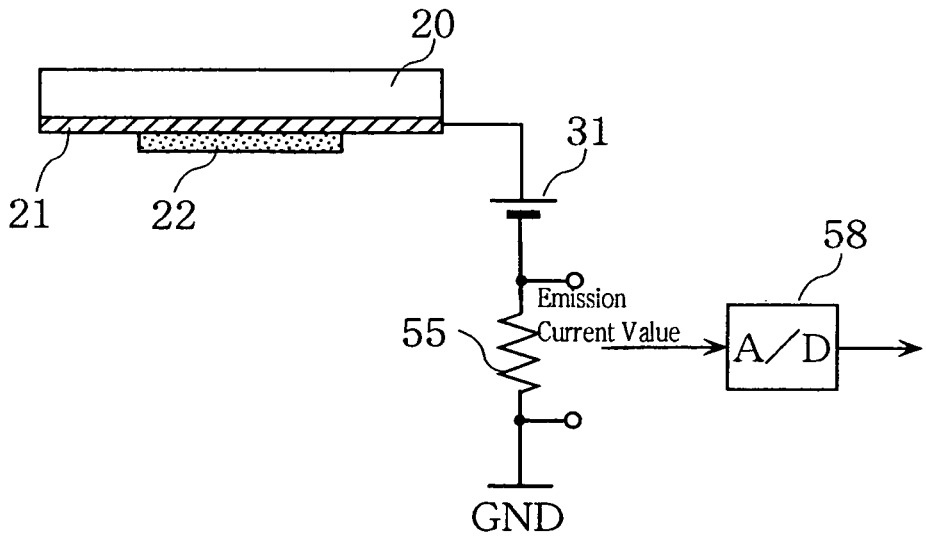
FIG. 12 is a diagram showing the configuration of another means of capturing luminance.

In addition, in the case of a CCD with a low resolution and when aiming to improve S/N (signal, noise) ratio, measurement may be carried out using 3-CCD configuration as shown in FIG. 11. The configuration includes a dichroic prism 51 and 3 CCDs 52, 53, and 54. The dichroic prism 51 separates the entering light into its respective colors, whereby the light is incident on the 3 CCDs as R, G, and B light respectively. It is desirable that the resolution of each of the CCDs be the same as the resolution of the display panel 9, making it possible to measure the luminance of the subpixel units in one operation with a good S/N ratio.

With the CCD capturing means described above, capture by the CCDs in one operation is difficult when the resolution of the display panel 8 reaches HD class (1980×1080). In such a case, the display panel 9 is divided into small regions, and the luminance of each region is captured by a CCD and measured. For example, the display panel 9 is divided into 4 small regions, and the luminance of each small region is individually measured. When the data of the small regions are combined into one screen, however, differences in luminance at the boundaries between the small regions sometimes arise. In such cases, it is desirable to measure the characteristics of the CCDs in advance and carry out correction accordingly.

Configuration 2 for Luminance Capturing Means

In cases of using luminance correction that adjusts for change over time, it is necessary to repeat a luminance capturing operation after a given time period. When a CCD is used, it is necessary to reset the CCD, and convenience suffers. Thus, instead of a CCD as a luminance capturing means, a means such that luminance measurement is carried out by the display device itself is employed in repeating the measurement of luminance after a given time period, it not being necessary to provide an external measuring means.

In FIG. 2, a luminance capturing means is shown. The figure shows electron-emitting elements of a display panel 9 and the portion including an anode electrode 21 and an anode source 31 (FIG. 2). The means has a configuration such that a measuring resistor is inserted in series between GND (common potential) and the anode source 31. Electrons emitted from the electron-emitting element are accelerated by the anode electrode 21, whereby the electrons collide with the phosphors causing the phosphors to emit light. The emission current corresponding to the luminance flows from the anode electrode 21 to the anode source 31. This current is detected by the measuring resistor 55. For example, supposing the emission current is 2 μA, if the resistance of the measuring resistor 55 is taken to be 250 kΩ, the voltage across the resistor will be 5 V. This measured value is converted to digital by, for example, the A/D converter 58 and is supplied to the correction value arithmetic unit 6 as luminance information.

Configuration 3 for Luminance Capturing Means

Figure 13:
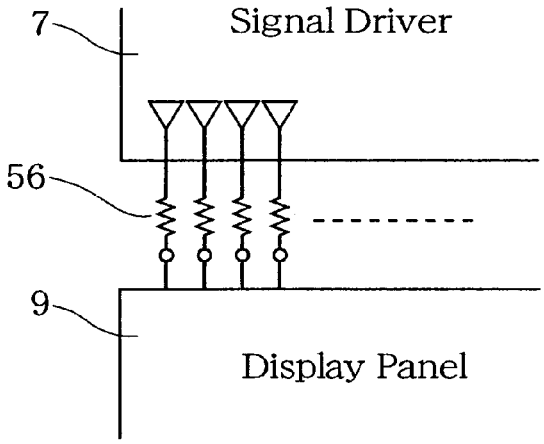
FIG. 13 is a diagram showing the configuration of yet another means of capturing luminance.

In FIG. 13, another luminance capturing means is shown. The configuration of the means is such that a current limiting resistor 56 is connected in series between the display panel 9 and the signal driver 7. When the display panel 9 is made up of electron-emitting elements, it is common that the current limiting resistor 56 provide direct current resistance to suppress the current variation of the electron-emitting elements.

The current flowing to the current limiting resistor 56 corresponds to the number of electrons emitted from the electron-emitting element 24 after current has flowed to the anode electrode 25, and may be considered the equivalent of emission current. Because this is the case, the driving current from the signal driver 7 is detected using the current limitation resistor 56, this driving current is converted into luminance information by an A/D converter (not shown in figure), and the luminance information is supplied to the correction value arithmetic unit 6.

Configuration 4 for Luminance Capturing Means

As yet another luminance capturing means, it is possible to use a current detector that utilizes the Hall effect, in which case it is not necessary to use a resistor as described above that reads a current value as a voltage value. Because current values can be detected without contact, it is possible to set up a control circuit that is not connected to the high voltage driving system.

Operation of Luminance Capturing Means

Figure 14:
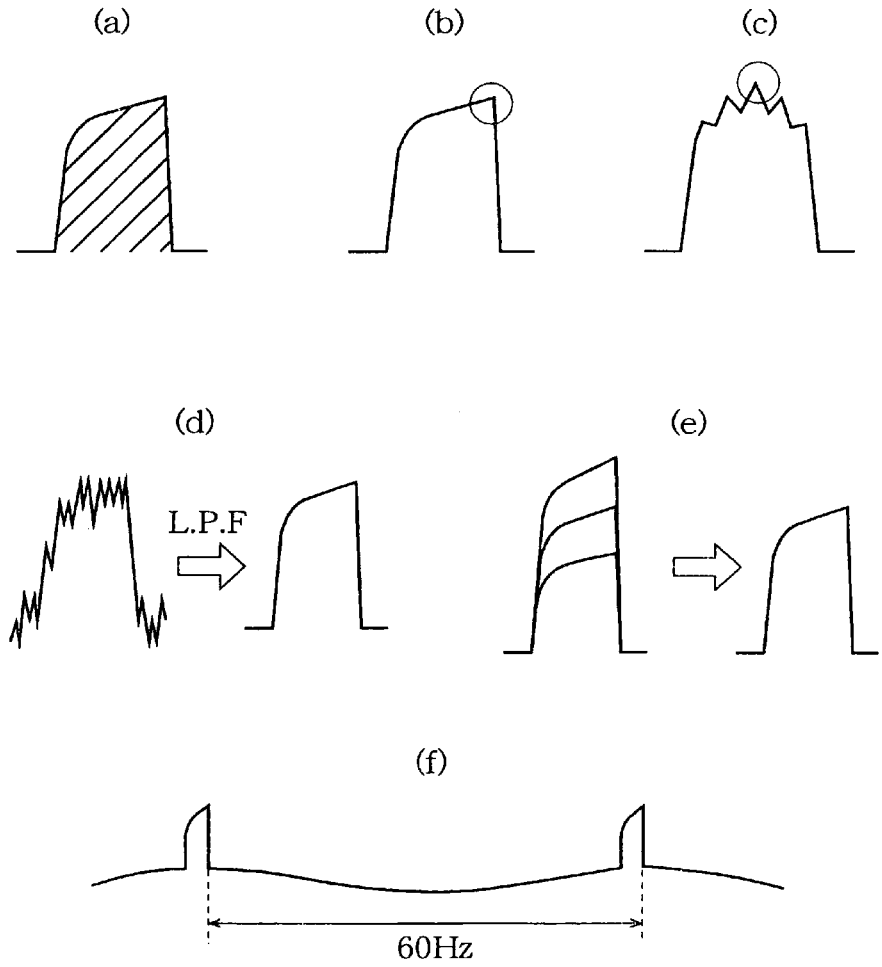
FIGS. 14(*a*) to 14(*f*) are diagrams each showing one example of a detected waveform of embodiment 1.

A method of actually retrieving luminance signals with the luminance capturing means described above will be described. During the short idle periods of video, pulse driving is carried out and information related to luminance (for example, anode current) is captured. An example of a detected waveform is shown in FIG. 14(*a*). Because the driving takes the form of pulse waveforms, detected amount is also a pulse waveform. The luminance information, in principle, is equivalent to the integral of the detected waveform. Supposing it is possible to build in a high speed integration circuit, it is ideal to use the integral amount of the detected waveform as the luminance information.

In actuality, however, because the duration of the pulse driving is short, the conversion speed of the integration circuit becomes a problem. In consideration of this, a method will be described where a value is captured with simple configurations, without using the integral amount.

FIG. 14(*b*) is an example where the final value among amplitude values of the detected pulse waveform is taken to be the captured amount. From the perspective of response speed, this is suitable in cases where it is preferable to take as much time as possible. The configuration includes a sample hold circuit and the like, and the driving signal is used, unaltered, as the captured signal.

FIG. 14(*c*) is an example where the peak value of the detected pulse waveform is captured, and it is possible that the configuration include a peak hold circuit.

FIGS. 14(*d*), 14(*e*), and 14(*f*) show effective means for combating noise.

FIG. 14(*d*) is a diagram showing an example of a detected pulse waveform subject to noise, and in this unaltered state, it is not possible to detect accurate information. In consideration of this, the pulse waveform is passed through a lowpass filter for eliminating the high frequency component, and using the resulting waveform, the capturing means of (a)–(c) are applied again.

FIG. 14(*e*) corresponds to a case where according to the characteristics of the driving elements, luminance information varies to a degree. It also corresponds to a case of variance due to noise. The point of capture may be that of any of (a) to (c). The luminance capturing operation is carried out a plurality of times, the average value is calculated, and this value is taken as luminance information. By carrying out this operation, the singular point of captured values can be averaged.

FIG. 14(*f*) shows a case subject to the power frequency (in Western Japan, 60 Hz) in the form of noise. In this case, the waveform is such that the component of power frequency has been added to the detected pulse waveform. To counter this, it is possible, using a filter that allows the high frequency component only to pass through, to capture only the detected pulse waveform. Alternatively, by synchronizing the luminance capturing operations with the power frequency, waveforms can be detected in the same phase as the power frequency, whereby it is possible to remove this component.

Employing the systems of FIGS. 14(*d*)–(*f*) in the manner described above makes it possible to eliminate the noise component.

In addition, by employing the systems in the manner described above, it is possible to capture luminance information with a simple configuration.

Operation of Luminance Correction

Figure 15:
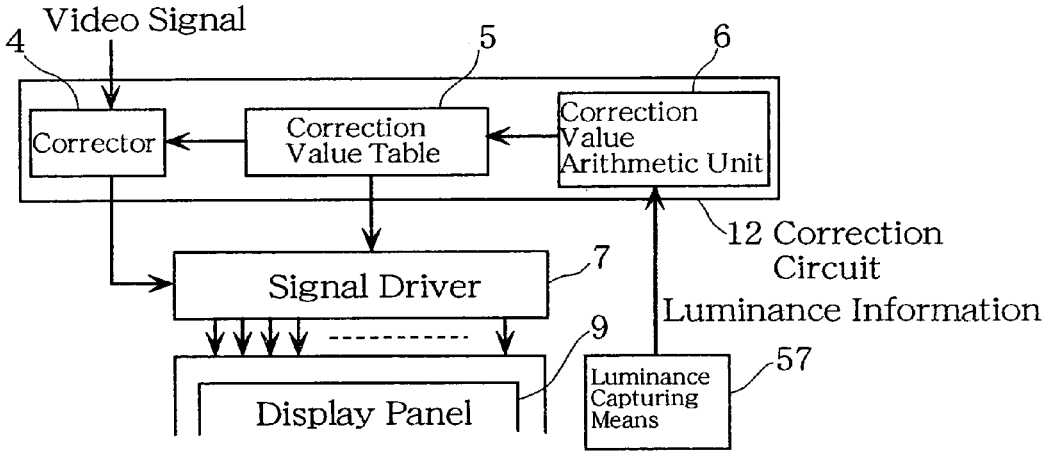
FIG. 15 is a diagram showing one example of the configuration of a correction circuit according to embodiment 1.

FIG. 15 is a functional block diagram of the correction circuit 12. The correction circuit 12 has the function of suppressing luminance variation between the pixels. First, values related to luminance are measured by the luminance capturing means 57 mentioned above. The values related to luminance are supplied to the correction value arithmetic unit 6 and correction values are calculated. The correction value arithmetic unit 6 performs comparison operations between the measured values related to luminance and target luminance values to determine amounts of deviation or the like and stores correction values for making each of the pixels reach target luminance to the correction value memory 5. A corrector 4 retrieves correction values from the correction value memory 5, the correction values corresponding to the pixel positions to be driven, and a time series of video signals Luminance signals) are corrected. Signals that have been corrected are supplied to the signal driver. As an alternative method of correction, a system may be employed where the signal driver retrieves, from the correction value memory 5, correction values corresponding to the pixel positions to be driven and renews gray scale command values. Thus, correction values are used to correct gray scale signals in accordance with the luminance characteristics of each pixel.

Method of Luminance Correction 1

Figure 16:
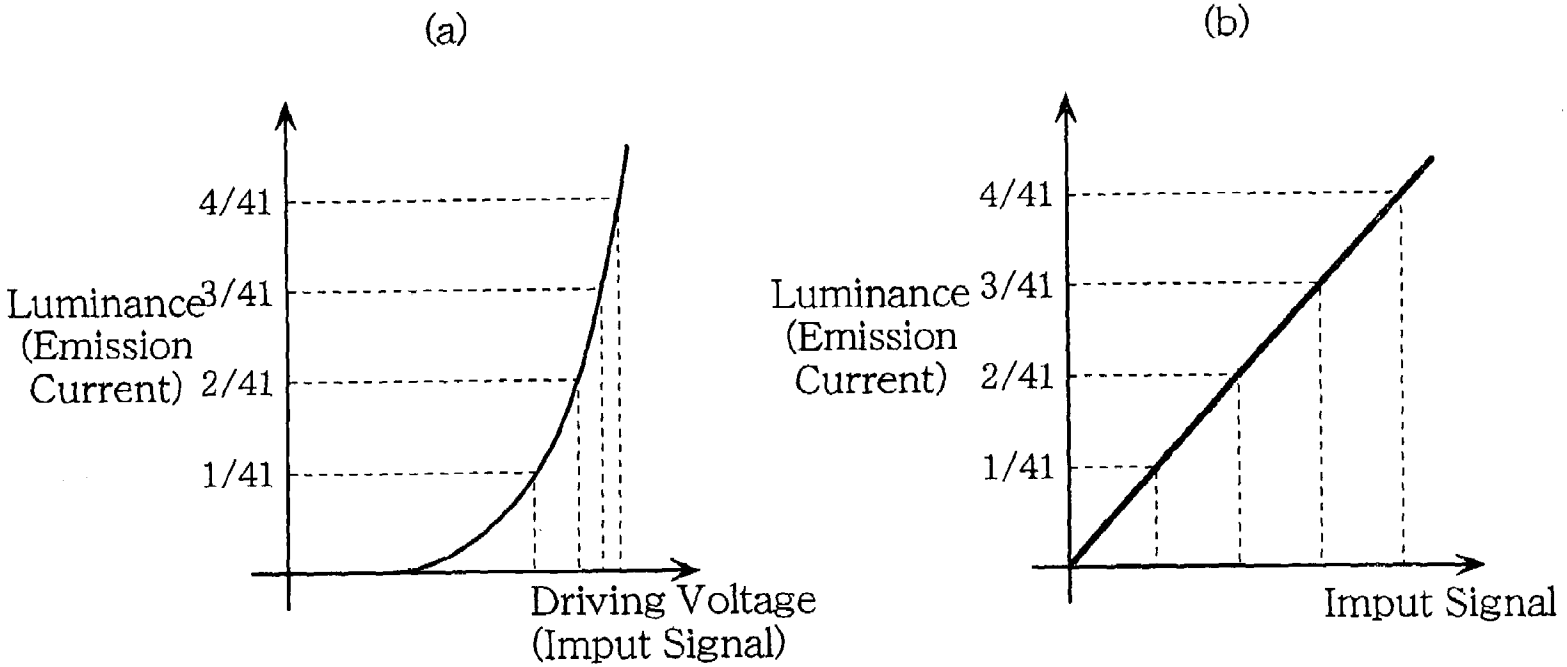
FIGS. 16(*a*) and 16(*b*) are each graphs showing one example of output characteristics of embodiment 1.

A method of correction will now be explained. In FIG. 16, the voltage-current characteristics of an electron-emitting element are shown as an example. The characteristics are nonlinear. In the case of realizing gray scale control by varying current value with values separated by regular intervals, the resulting driving voltages are not levels separated by regular intervals. For this reason, deviations arise when values for video signals are supplied, unaltered. In addition, these current characteristics are not the same among all the electron-emitting elements of a display panel, but rather are different in each. In order to obtain characteristics that are proportional to the input signals, correction must be carried out to realize the relationship illustrated by FIG. 16(*b*). To carry out this correction, first luminance information from all the pixels is captured by the luminance capturing means 57 and is compared with target luminance. When there is a deviation from the target luminance, driving voltage is changed and luminance is measured again. By repeating this process, a voltage value that converges to the target luminance is determined. In addition, in cases of measuring element characteristics in advance, a driving voltage that realizes a target value can be used. This value that realizes target luminance is written to a correction value table. The correction value may be an absolute value or a proportionality coefficient with respect to a given reference value. For example, as there are 4 levels of target luminance as shown in FIG. 16, a correction value is obtained for each and the correction values are written to the correction value table. Thus, the correction value table accommodates the number of values corresponding to the number of pixels (pixels or subpixels)×the number of gray scale levels.

Alternatively, supposing the gray scale control is achieved by common pulse width modulation, there is only one given current value and the correction table need only accommodate the number of values corresponding the number of pixels. The corrector 4 retrieves correction values from the correction value table and, in correspondence with display position, carries out the sequential correction of video signals that have been supplied sequentially. In this process, the correction values (current or voltage values) may be used, unaltered, though it is also possible to obtain correction values from correction expressions and correct input signals by computation.

Thus, the present invention provides a method of driving where gamma correction of video input signals is carried out using the luminance table. By provision of data for each gray scale in all of the pixels to carry out correction, it is possible to correct variation in luminance within the display panel with good accuracy.

Method of Luminance Correction 2

Figure 17:
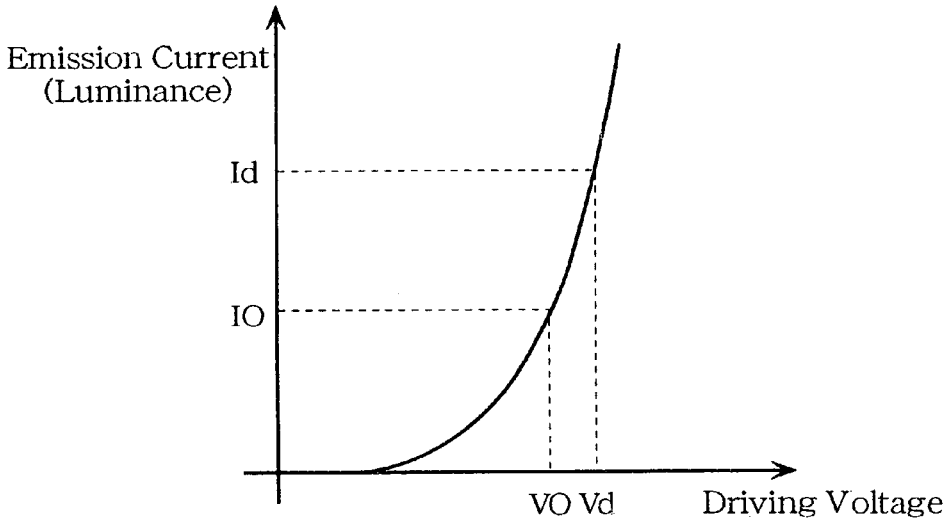
FIG. 17 is a graph showing one example of output characteristics of embodiment 1.

Another method of correction will now be explained. In FIG. 17, driving characteristics of pixels in a given area of an image display device are shown. The voltage-current characteristics of an electron-emitting element are shown as an example, and these characteristics are nonlinear.

First, suppose that the signal driver 7 carries out, for example, output pulse width control. Next, suppose that a given specified pixel only is driven by, for example, a full-white signal (driving voltage of 0 V). At this time, the luminance of this pixel is IO. There is variation in luminance among the electron-emitting elements in the pixels, such that even if a same voltage is applied, a same luminance is not necessarily obtained. The characteristics shown in FIG. 17 are such that when a given target luminance is Id, the actual luminance is IO, demonstrating that luminance is insufficient.

Luminance information is measured as an emission current value Ie by an anode current capturing means. Suppose that emission current and actual luminance are measured in advance and a correlation is established. This emission current value Ie and the target value (a value having an established correlation with a target luminance value Id) are compared. Because, in this case, the value for Ie is the smaller value, a correction value is renewed in the direction of an increase in driving voltage. When the method of driving is output pulse width control, the amplitude value (driving voltage) is corrected. In this case, the correction value may be the value of the driving voltage itself or that of the proportionality coefficient.

Figure 18:
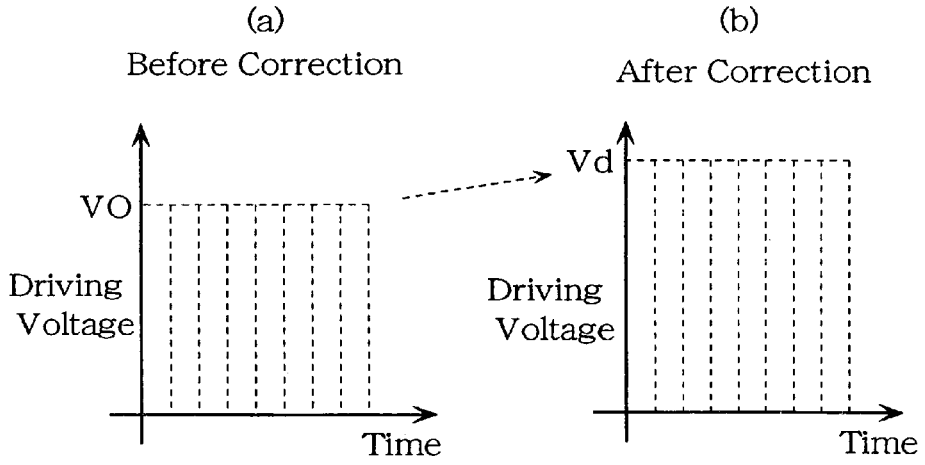
FIGS. 18(*a*) and 18(*b*) are each diagrams showing one example of an output waveform of embodiment 1.

This luminance capturing and correction operation is sequentially carried out across all of the pixels. Once renewal of the correction value has been carried out one time on all of the pixels, the correction operation is carried out again. Namely, until the deviation between the luminance information (the emission current amount Ie) and the target value (a value having an established correlation with a target luminance value Id) reaches or falls below a fixed value, the renewal of correction value is repeated. With regard to the conditions of convergence, as a rough measure of deviation, it is desirable that deviation from the target value be 40 dB or less, though this also depends on the image to be displayed. The gray scale realization waveform of the pixel referred to above is shown in FIG. 18. It is shown that the amplitude value was VO before correction, but Vd after correction (the conditions of convergence will be described later).

In the manner described above it is possible to match the target luminance of all of the pixels by correcting the driving voltages in accordance to the characteristics of each pixel, thereby making it possible to ameliorate variation in luminance.

In addition, supposing the gray scale control is that of common pulse width modulation, one value for a given target amplitude value is sufficient and it is suitable to prepare a correction memory for the number of pixels.

Note that gray scale control is not limited to pulse width control, amplitude control also being acceptable, in which case the correction value may be a pulse width or an amplitude value.

Method of Luminance Correction 3

Figure 20:
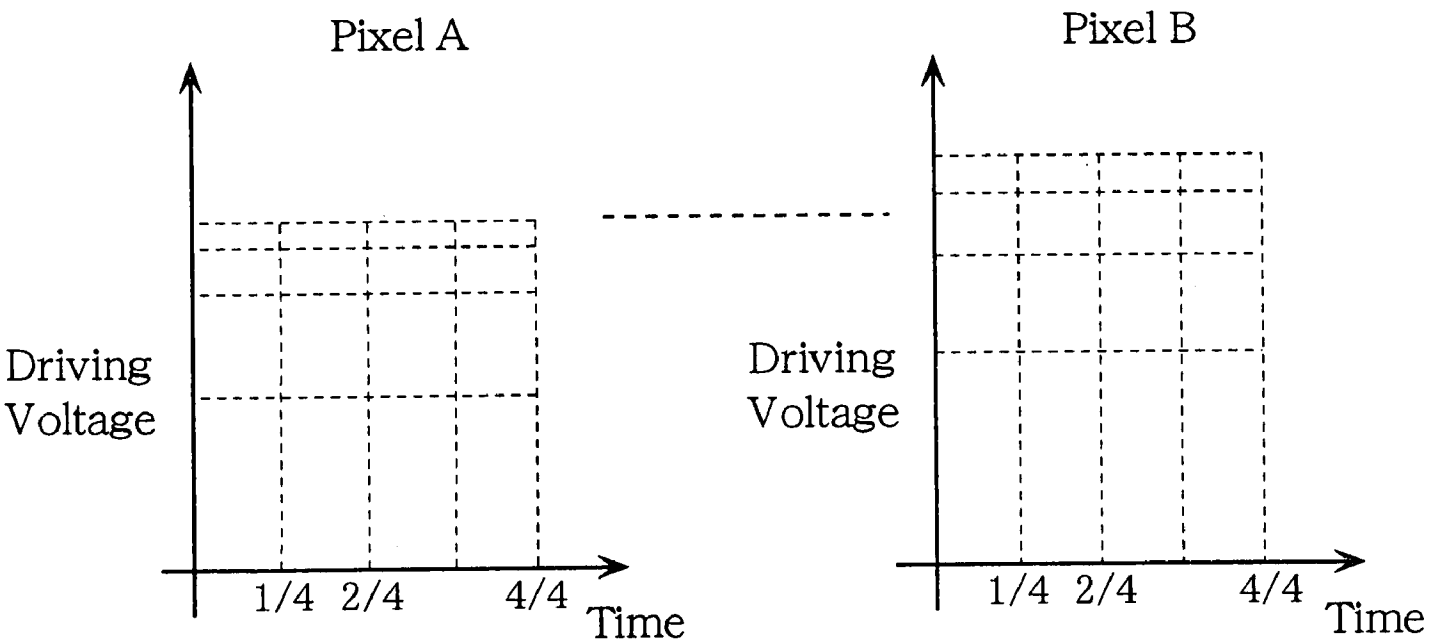
FIG. 20 shows diagrams each showing one example of an output waveform of embodiment 1.

A correction method for another system of gray scale will now be described. In this system, the corrector 4 is not used, but rather a decoder in the signal driver uses correction values from the correction value memory 5 to carry out correction. The decoder employs a system of realizing gray scale control by simultaneously carrying out amplitude control and pulse width control. FIG. 20 shows one example in which there are 4 levels of pulse width and 4 levels of luminance value (emission current value) to realize a total of 16 gray scale levels.

Figure 19:
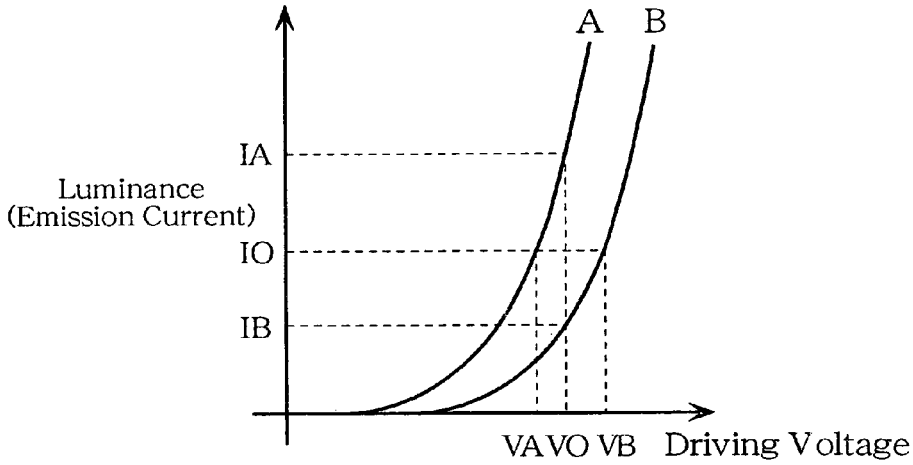
FIG. 19 is a graph showing one example of output characteristics of embodiment 1.

The operation by which luminance variation is corrected will now be described. In FIG. 19, two characteristics are shown. These are the characteristics of adjacent pixels A and B in a given area of the display panel 7. When a given target luminance value is 10, driving is carried out with a driving voltage of V0. Assume that characteristics are such that the pixel A emits light at a luminance IA, and a pixel B emits light at a luminance IB. In order that both pixels emit light at a same luminance, the driving voltages are corrected. Correction values are set so that the driving voltage of the pixel A is corrected to VA and the driving voltage of the pixel B is corrected to Vb. In this process, it is possible to use the values for the correction values (the voltage or current values), unaltered as the setting values, or to obtain correction expressions from the correction values and correct the input signals by computation. In addition, coefficient values (gains) from a reference value may be used as setting values.

By thus correcting the driving voltages in accordance with the characteristics of each pixel, it is possible to make luminance uniform. In addition, the output waveforms of the pixel A and the pixel B are as shown in FIG. 20. The pixel B has a driving voltage value higher than that of the pixel A, but this is because correction is used so that the luminance of each are the same.

At this time, it is necessary to obtain driving voltages to vary luminance between 4 levels separated by regular intervals. It is necessary that correction values or driving voltage values be written to the correction memory so that a luminance value for each pixel (pixel or subpixel unit) is one of 4 levels separated by regular intervals. Thus a correction value memory is prepared for the number of pixels (pixels or subpixels)×the number of gray scale levels. The decoder in the signal driver 7 retrieves correction values from the correction value memory, corrects the driving voltages, and outputs driving waveforms such as those shown in FIG. 20, in correspondence with the pixels to be driven.

In this manner, the decoder uses the correction value memory to correct driving voltages for each pixel so that luminance levels reach target values, thereby making it possible to precisely control luminance. It is thus possible to accurately correct luminance variation within the display panel.

As described above, provision of a luminance capturing means and a correction value memory makes it possible to correct non-uniformity in luminance among the pixels.

Note that the number of levels of gray scale is not limited to that described above, but may be an arbitrary number. In addition, while driving voltage values were corrected, there are other possibilities, it being acceptable to correct driving current values.

When using driving current values, there are cases of carrying out constant current control for making a driving current constant. It is such that driving current constant control is carried out so that generally a cathode current is constant, whereby it is possible to carry out constant control for luminance also. For this reason, it is thought that correction is not necessary. However, even if anode current is controlled constantly in practice, the luminance does not remain constant because of leakage current from the extraction electrodes and the like. In other words, even with systems of driving that carry out constant current control, the present invention is effective for precisely controlling luminance by correcting current values in accordance with the luminance.

The system of gray scale control is not limited to this, it also being possible to use pulse widths as correction values.

Luminance Correction Operation 4

Figure 51:
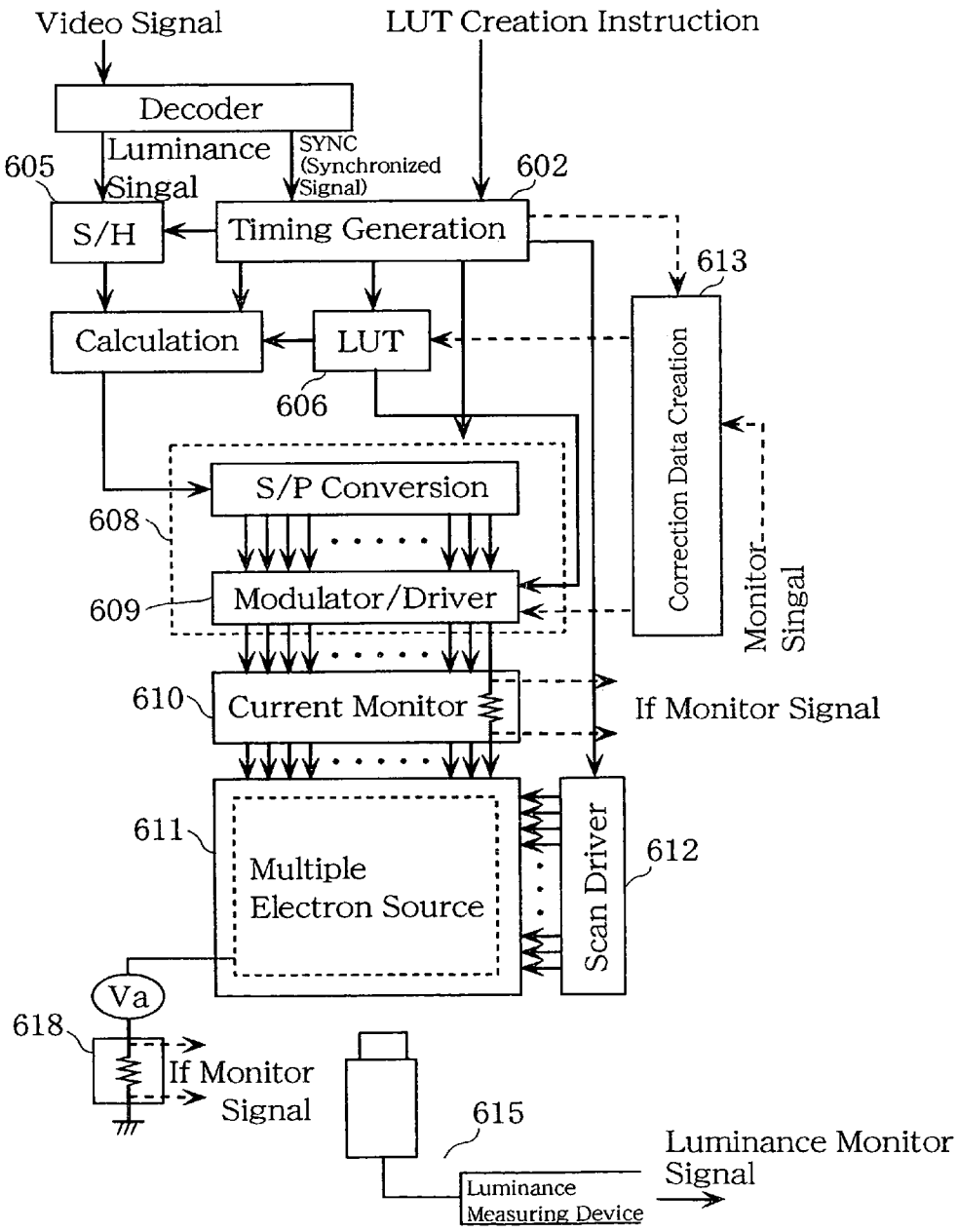
FIG. 51 is a diagram showing one example of a conventional system of luminance correction.
Figure 52:
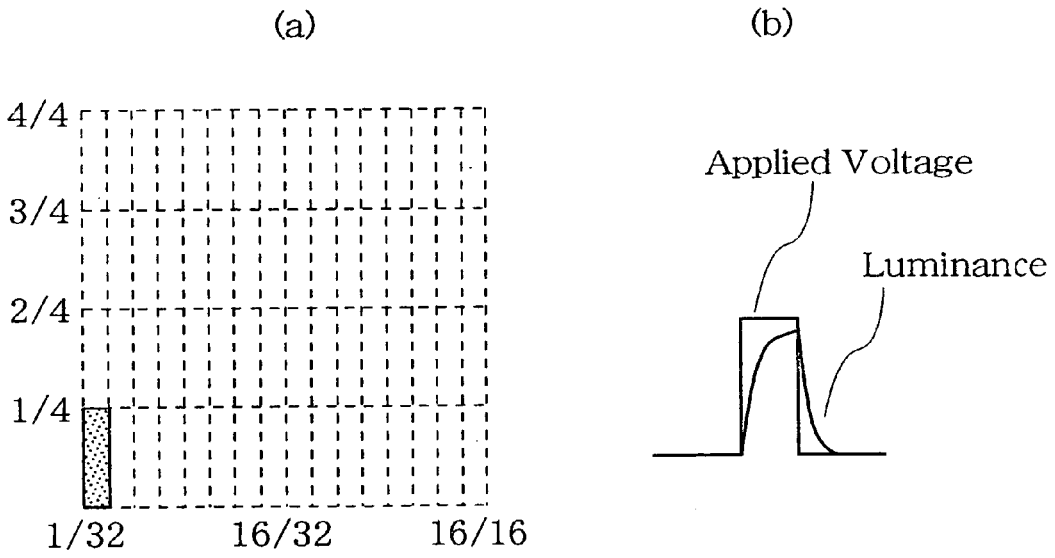
FIGS. 52(*a*) and 52(*b*) are each diagrams for illustrating a conventional system of gray scale control.

According to a configuration such as that described above, a system of gray scale realization for realizing high resolution gray scale is obtained by combining output pulse width control and output amplitude control, without necessitating high speed and high precision from elements and driver circuits. With this system of gray scale control, however, a problem arises during display of low luminance, as is illustrated by FIG. 51.

Figure 21:
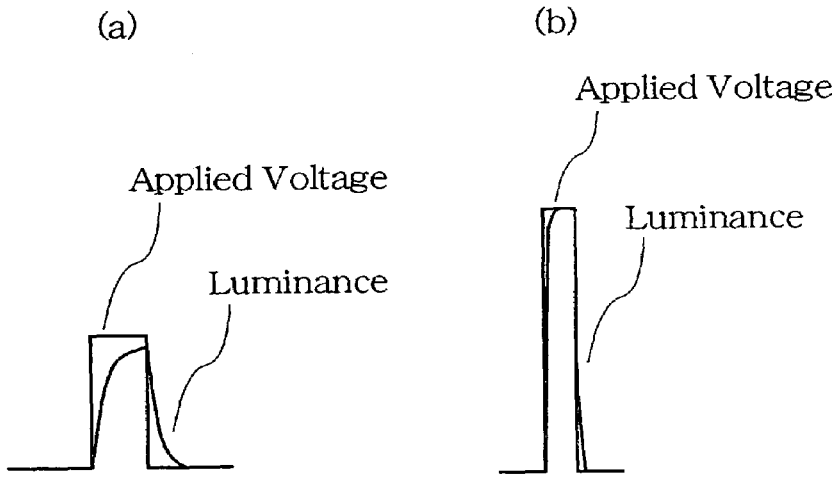
FIGS. 21(*a*) and 21(*b*) are each diagrams showing the relationship between applied voltage and luminance.

In consideration of this, when displaying low luminance (for example, when outputting one of the first 16 gray scale levels), it is necessary to increase amplitude value (driving voltage or current) in order to increase response speed (FIG. 21).

Figure 22:
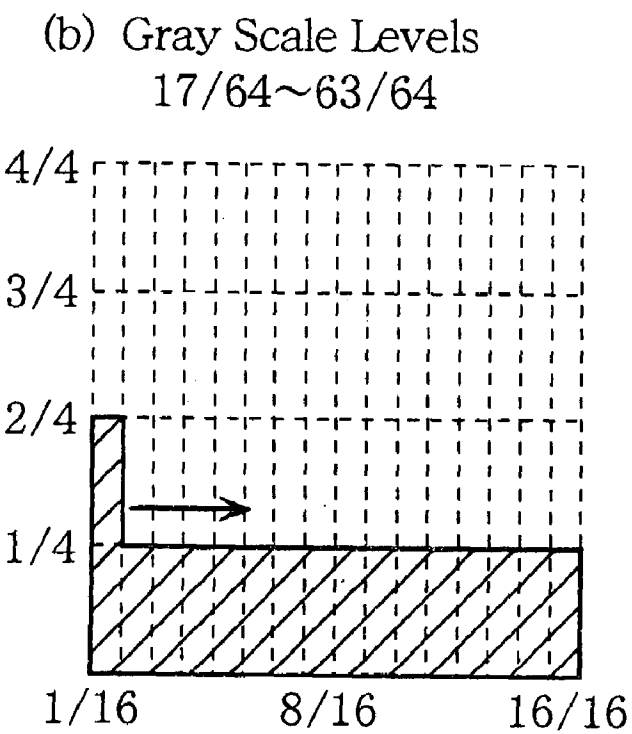
FIGS. 22(*a*) and 22(*b*) are each diagrams showing one example of an output waveform of embodiment 1.
Figure 22:
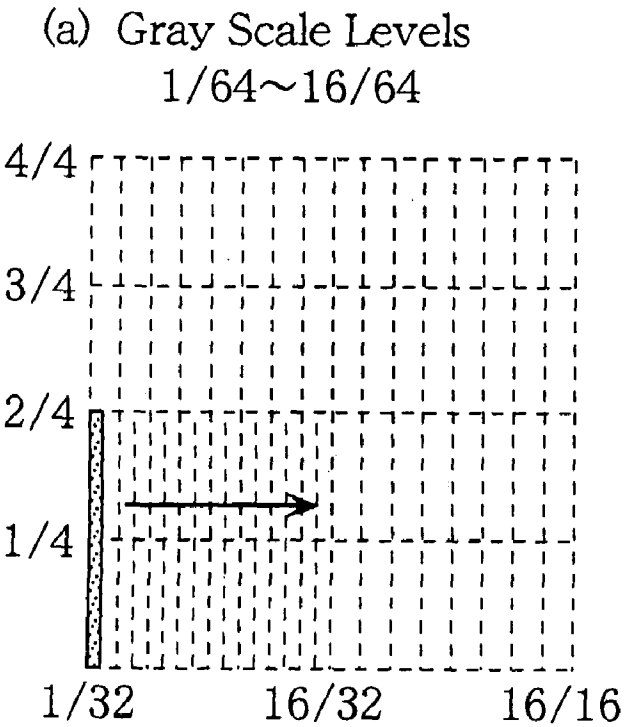

In other words, for the first 16 gray scale levels, the amplitude value is doubled and gray scale outputted by only amplitude control (FIG. 22). Although the pulse width is reduced by ½, the duration of a pulse is twice that of a pulse in common pulse width control (when amplitude is 4/4), so that response speed is within a sufficiently fast range.

By thus doubling amplitude and outputting gray scale only by pulse width control, the response speed of the elements is sufficiently fast and it is possible to output with good accuracy even during display of low luminance. When the first 16 gray scale levels are exceeded, pulse width control is terminated and a common system of gray scale realization is resumed (FIG. 22(*b*)). This is because gray scale values for gray scale levels of 17/63 or higher are amplitude values of ¾ or higher, and thus, there is no problem in terms of response speed.

By thus carrying out pulse width control for low luminance levels and a system of gray scale control where pulse width control and amplitude control are simultaneously carried out for high luminance levels and switching between the systems, it is possible to output gray scale with good accuracy at low luminance levels.

Figure 23:
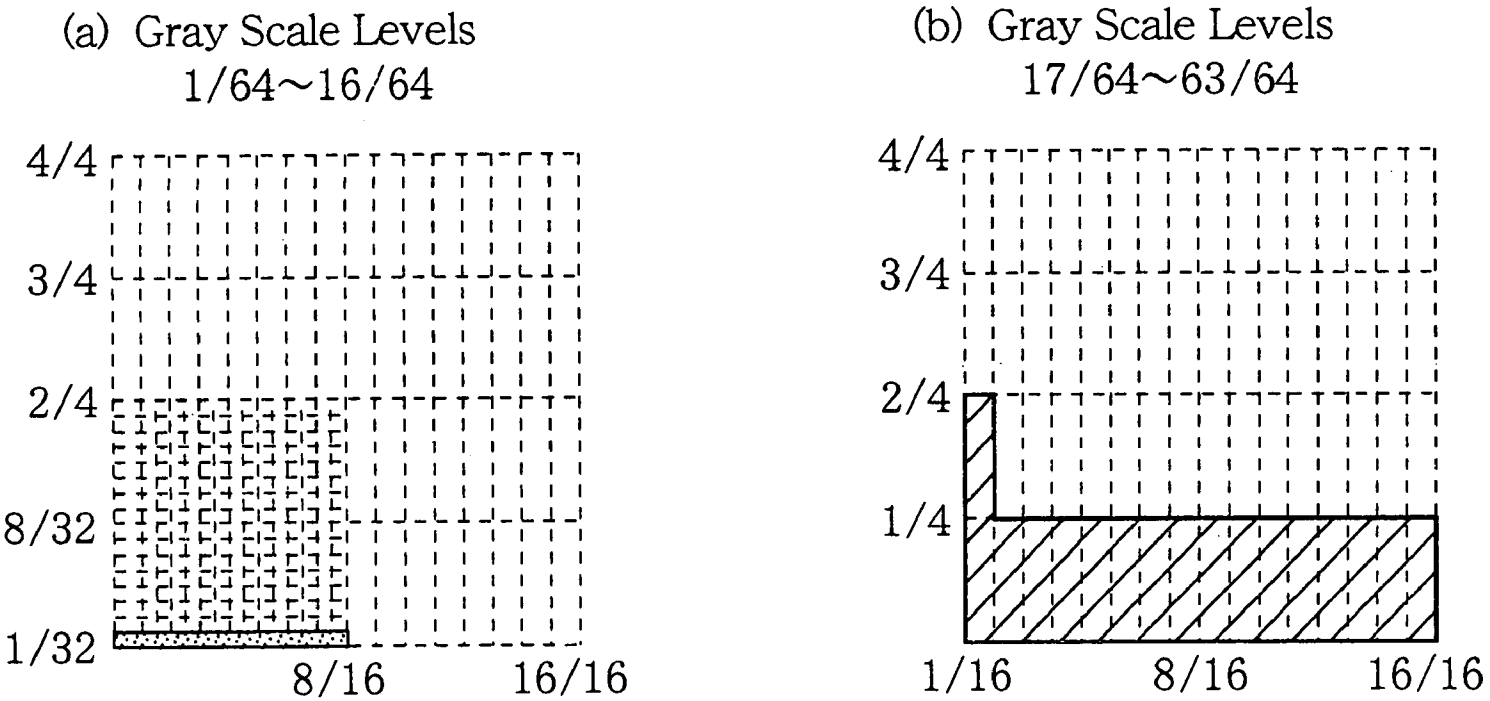
FIGS. 23(*a*) and 23(*b*) are each diagrams showing one example of an output waveform of embodiment 1.

Alternatively, when the response speed is slow at low luminance levels, amplitude control as shown in FIG. 23(*a*) may be used instead of pulse width control. In this case, pulse width is extended up to ½ of the maximum value, such that duration is lengthened to the point at which the response of the elements is sufficiently fast. By carrying out such control, gray scale can be outputted with good accuracy even if amplitude control is carried out. Thus, for low luminance levels (for example, when outputting the first 16 levels of gray scale), amplitude control is carried out, and beyond these levels, amplitude control is terminated and the common system of gray scale realization resumed (FIG. 23(*b*)). In this manner, by carrying out amplitude control at low luminance levels and a system of gray scale where pulse width control and amplitude control are simultaneously carried out at high luminance levels and switching between the two systems, it is possible to output gray scale with good accuracy at low luminance levels.

In either of these two methods of realization described above, the first 16 levels of gray scale, i.e., the number of grays scale levels of pulse width control in a system of gray scale where pulse width control and amplitude control are carried out simultaneously, is used for the timing of switching, but timing is not limited to this.

For example, for the switching between systems of gray scale, a boundary may be drawn at 50% of the number of gray scale levels. When at 50% or less than the maximum value for luminance or maximum number of gray scale levels, amplitude control or pulse width control may be carried out, and when at 50% or higher than the maximum value for luminance or maximum number of grays scale levels, a system of gray scale may be carried out where pulse width control and amplitude control are carried out simultaneously. The boundary value is set at 50% because when output pulse width control, for example, is carried out with the amplitude value made constant at 50% the maximum value during display at a low luminance level, the luminance that can be realized is 50% of the maximum value.

Luminance Correction Operation 5

In addition to the system of control of the present invention described above (luminance correction operation 4), a system where the switching of the system of gray scale realization is carried out according to time will be explained.

Figure 24:
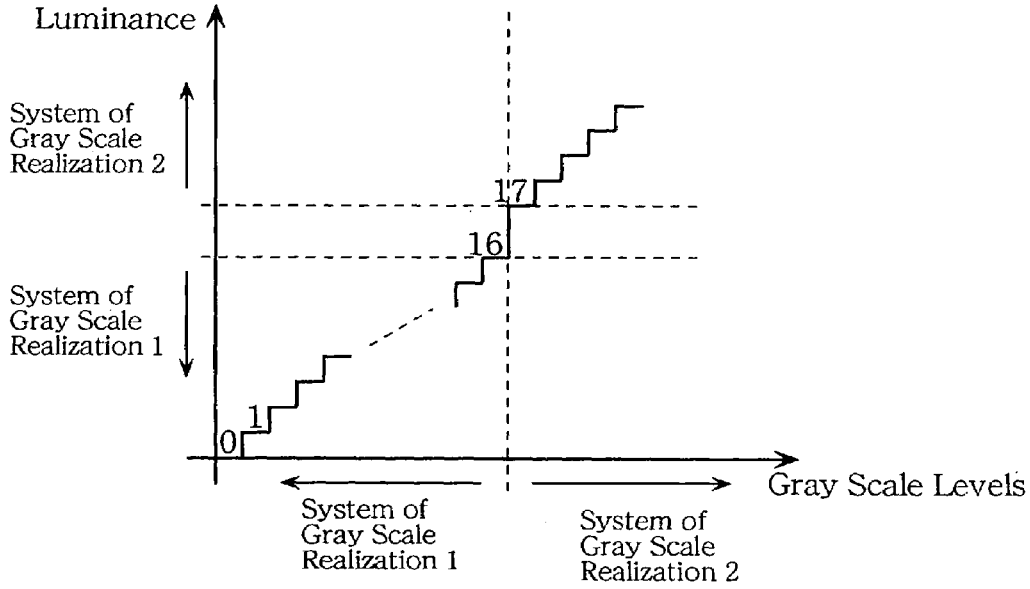
FIG. 24 is a diagram for illustrating switching between systems of gray scale realization.

FIG. 24 shows one example, and the example is described with reference to the figure. In FIG. 24, consider the case in which a system of gray scale realization 1 is carried out for, for example, the 16 levels of grays scale having low luminance levels, and a system of gray scale realization 2 is carried out for the gray scale levels 17 and higher.

Possibilities for the system of gray scale realization include output pulse width control, output amplitude control, a system of gray scale where output pulse width control and output amplitude control are simultaneously carried out, and the like, it being acceptable to select the system arbitrarily according to the elements.

In this case, because the two systems of gray scale realization differ, differences in luminance may arise at the boundary between the methods. Consequently, when an image is displayed, a luminance difference arises in this portion, whereby there is the adverse effect of the appearance of a false contour.

Figure 25:
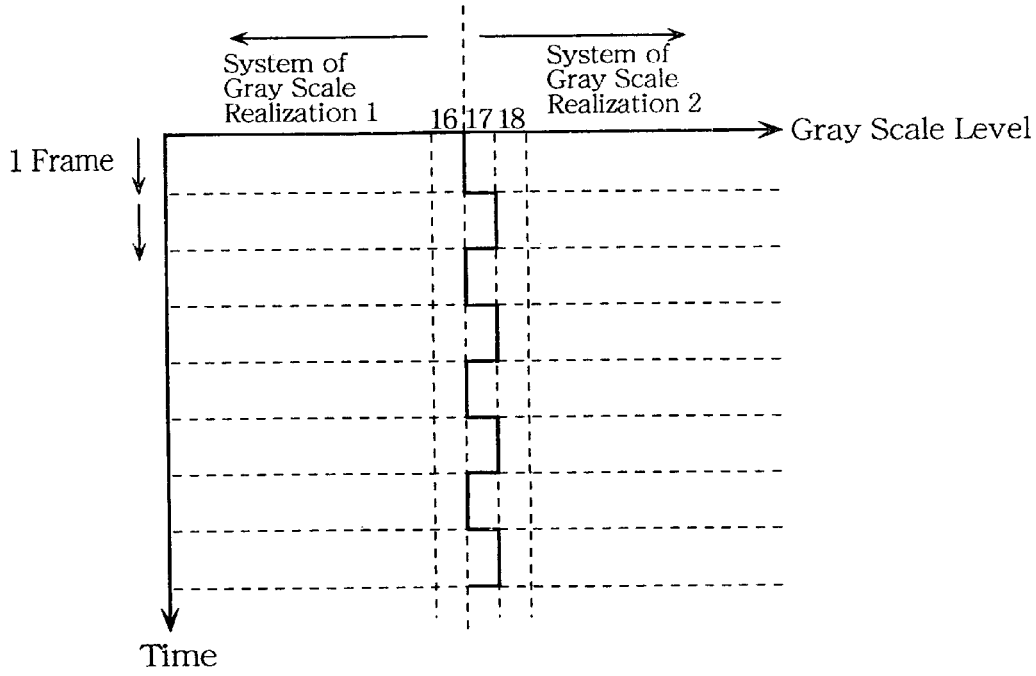
FIG. 25 is a diagram for illustrating another switching between systems of gray scale realization.

In order to reduce these effects, the number of gray scale levels before switching between systems of gray scale realization is varied according to time, as is shown in FIG. 25. In FIG. 25, in the first frame, the system of gray scale realization 1 is carried out though the $16^{th}$ gray scale level and the system of gray scale realization 2 is carried out from the $17^{th}$ gray scale level and higher. In the next frame, the system of gray scale realization 1 is carried out through the $17^{th}$ gray scale level and the system of gray scale realization 2 is carried out from the $18^{th}$ gray scale level and higher. This process is repeated every frame.

By thus changing the number of gray scale levels before switching every other frame, changes in luminance are alleviated such that luminance shifts can no longer be perceived.

As described above, by switching the system of gray scale realization according to time, gray scale can be displayed without any reason for concern.

Note that the method of switching according to time and the switching amount (1 gray scale level) is not limited to this, it being acceptable to shift between 2 gray scale levels or more. In addition, the timing of the switching (1 frame) is not limited to this, it being acceptable to carry out switching every 2 frames or more or according to different time units. Any variation is possible as long as the characteristics of the elements for display are taken into account, so that luminance shifts do not stand out.

Operation for Correction of Change Over Time

The luminance correction methods described above are systems of correcting luminance non-uniformity in the initial state. If correction is carried out on initial characteristics during inspection or the like at the panel shipment stage, a uniform display can be realized. However, even if there is no luminance non-uniformity in the initial state, it sometimes happens that, for example, in the case of displaying the same information for a long period of time, degradation progresses faster in the pixels that have been carrying out display than in the other pixels. For example, even if a same driving voltage is applied, pixels in which degradation has progressed have a reduced luminance. For this reason, when all of the pixels are illuminated at 100% luminance, even if correction is carried out in the correction table, a portion of light-emitting elements that had displayed a given display of information has a lower luminance than other portions because the degradation of this portion of light-emitting elements has progressed further. Thus, differences in luminance arise, resulting in a phenomenon similar to sticking.

In order to eliminate this phenomenon, a luminance correction method that has been described hereinbefore is employed and the correction value memory is renewed.

For example, for a display panel that has been operated for a fixed length of time (for example, 1000 or 2000 hours), correction is carried out again. However, because a correction operation is sequentially carried out on each of the pixels, a certain amount of time is required, making it necessary to interrupt video display during operation.

The present invention makes it possible to correct luminance variation without having to interrupt video display. An example of operation is described below.

Figure 26:
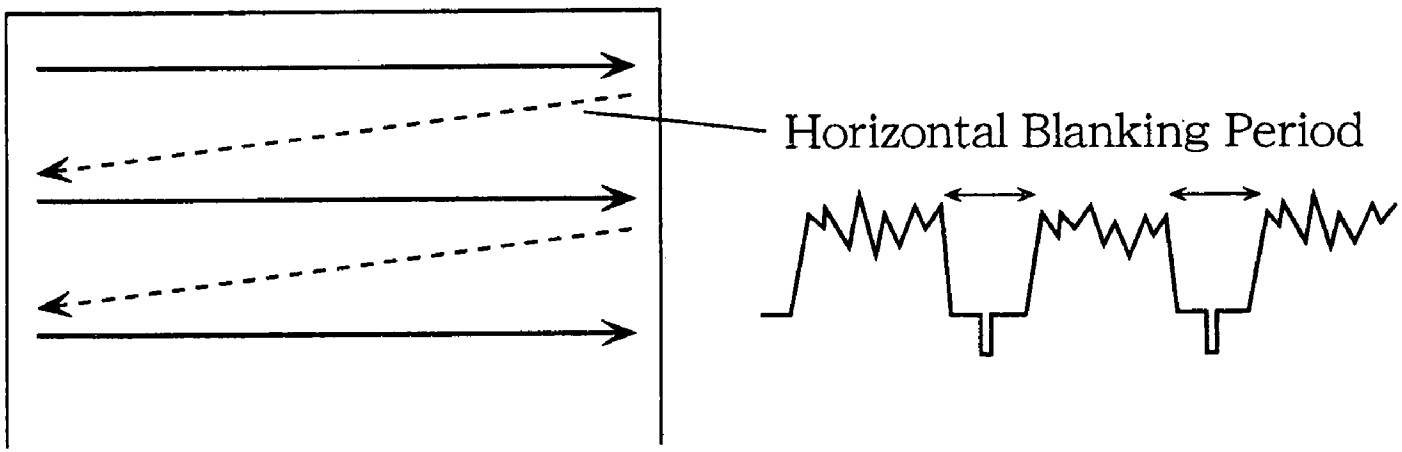
FIG. 26 is a diagram showing one example of output characteristics of embodiment 1.
Figure 27:
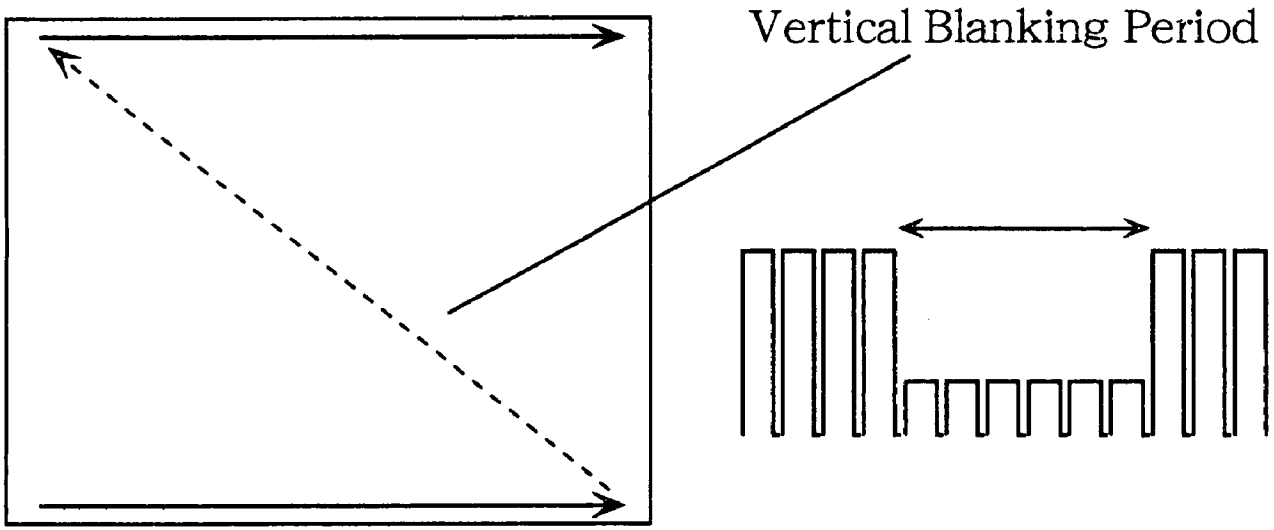
FIG. 27 is a diagram showing one example of output characteristics of embodiment 1.

FIGS. 26 and 27 are schematic diagrams related to video information and scanning methods used in CRTs and the like. In a CRT, blanking periods must exist for the scanning of electron beams. In addition, ground-based broadcasting NTSC video signals have these blanking periods, which are separated into horizontal blanking periods (FIG. 26) and vertical blanking periods (FIG. 27).

With the NTSC standard (EIA RS-170A), a horizontal blanking period is 10.9±0.2 μs and a vertical blanking period is 20H (H: 1 horizontal blanking period, about 63.5 μs)=1.27 ms. With the high-definition television standard, horizontal blanking periods are 3.77 μs and vertical blanking periods are 45 lines (line frequency 33.75 kHz)=1.33 ms.

Throughout the blanking periods, there is no video output, just idle time. Using these blanking periods, luminance correction operation is carried out in given pixels.

Because it is not necessary to consider the effect of correction on video output during the initial stage operations for correcting luminance variation, luminance correction operations may be carried out successively. In addition, initial correction may be such that correction operations are carried out during blanking periods.

Configuration of the Device

In realizing the systems of gray scale driving and systems of luminance correction described hereinbefore, a driver-IC is generally used. When this is the case, the circuit for calculating correction values, the correction table, the corrector, and the like may be built into one chip. In addition, a configuration where in the driver-IC for realizing gray scale, a correction table is provided to carry out correction is conceivable. By thus building functional blocks into one chip, the cost of the driver is reduced, contributing to an overall reduction in cost, and size and weight of the device is reduced.

An image display device equipped with such a driver device makes it possible to provide a low-cost device that not only realizes gray scale with good accuracy, but suppresses luminance variation and realizes a reduction in size and weight.

As has been described hereinbefore in the examples of the present invention, employing a system of gray scale realization that carries out pulse width control and amplitude control simultaneously makes it possible to output gray scale with good accuracy even in a display panel having high resolution, and utilizing a luminance correction means including a correction memory makes it possible to suppress initial luminance variation and that arising with change over time. Even with panels that have been designated defective during panel production because of problems with gray scale and uniformity, it is possible to improve performance and characteristics. For this reason, production yield is increased, whereby it is possible to provide a good quality image display device at low cost.

It should be noted that while gray scale control and luminance correction were described using electron-emitting elements in the present embodiment, this description is also applicable to display operation with organic EL or LED elements.

Embodiment 2

Figure 28:
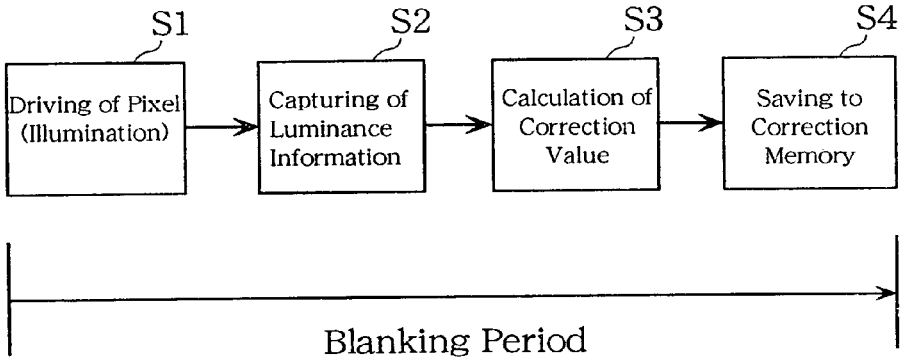
FIG. 28 is a diagram showing a luminance correction method according to embodiment 2.

Embodiment 2 describes another example of an operation for correction of change over time. A method of correcting luminance in accordance with the present embodiment 2 will be described with reference to FIG. 28. Consider a given blanking period (horizontal or vertical). A pixel is driven to illuminate, luminance information (for example, anode current) is captured, a correction value for driving is calculated, and this correction value is stored in the correction memory. This series of operations is carried out during a blanking period. Carrying out this operation during a blanking period makes luminance correction operation that does not affect video output possible. In addition, because the pixels are illuminated one at a time and for extremely short durations, this method is advantageous in that the user cannot perceive the emitting of light.

For example, suppose that this operation is carried out during an NTSC horizontal blanking period. If the element is capable of high-speed response and the light-emitting operation can be carried out during the period (10.9 μs), a correction operation can be carried out one pixel at a time with one correction operation being carried out in one horizontal blanking period. Because correction without affecting video output is possible, it is not necessary to consider the length of correction time, but for example, in the case of a panel having the equivalent of VGA resolution, the duration of one measurement is $640\times480\times1/525\times1/30=19.5$ (sec).

With an element that does not have a response speed on the order of microseconds, correction operations may be carried out during vertical blanking periods. For example, because an NTSC vertical blanking period is 1.27 ms, correction operation can be sufficiently carried out during this period. In the vertical blanking period, though one pixel only may be measured, it is also possible to measure a plurality of pixels in this blanking period if, for example, response speed of the pixel and correction operation together is completed in 100 μs.

When this is the case, the luminance correction operation of 10 pixels can be carried out in one vertical blanking period. In this case, because correction without affecting video output is possible, it is not necessary to consider the length of correction time, but for example, in the case of a panel having the equivalent of VGA resolution, the duration of one measurement is $640\times480\times1/100\times1/60=51.2$ (sec).

In this manner, in the blanking period of a video signal, pixels are driven to illuminate, luminance information is captured, correction values for driving are calculated, and these correction values are stored in the correction memory. This series of operations is carried out during a blanking period, making it possible to carry out a luminance correction operation without affecting video output.

Embodiment 3

Figure 29:
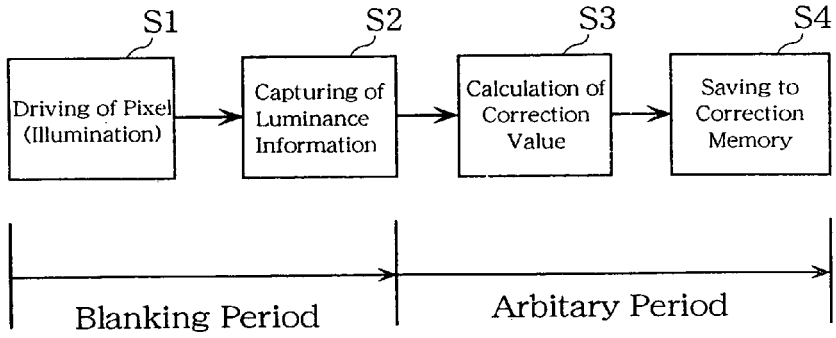
FIG. 29 is a diagram showing a luminance correction method according to embodiment 3.

Embodiment 3 describes another example of an operation for correction of change over time. A method of correcting luminance of the present embodiment 3 is shown in FIG. 29. Consider a given blanking period (horizontal or vertical). During this blanking period, operations of driving a pixel to illuminate and capturing luminance information (for example, anode current) only are carried out. This method, intended for cases of increased resolution and shortened blanking periods or the like, is such that only the minimum number of operations is carried out during a blanking period. As long as luminance information is captured during the blanking period, it is not a problem that the subsequent operations of correction calculation and memory storage overlap with the video signal operation or be carried out in parallel with the video signal operation.

In addition, it is possible to prepare a luminance information temporary storage memory (not shown in figure), to first carry out operations of pixel illumination and luminance information capturing on all of the pixels, and to temporarily store the information in the luminance information temporary storage memory. Regardless of the timing of video output, luminance information may then be read from the luminance information temporary storage memory and operations of a correction value calculation and a memory correction carried out for all the pixels.

In this manner, only operations of illuminating pixels and capturing luminance information are carried out during a blanking period, such that even if operations of a correction value calculation and storage in the correction memory are carried out according to a different timing, a luminance correction operation that does not affect video output is possible.

Embodiment 4

Figure 30:
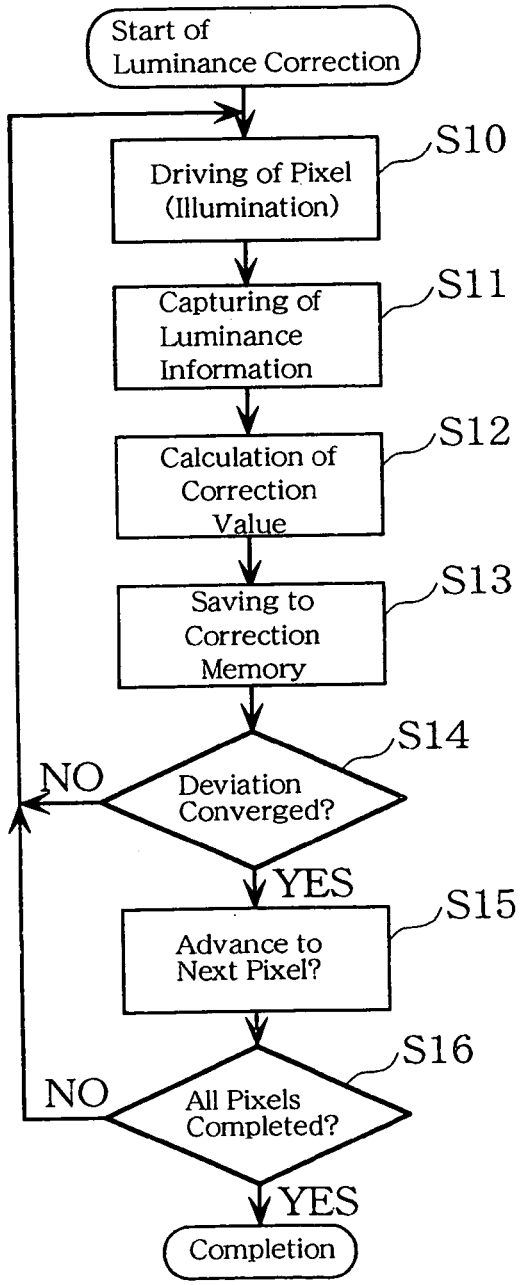
FIG. 30 is a flow chart showing a luminance correction method according to embodiment 4.

Embodiment 4 describes another example of an operation for correction of change over time. FIG. 30 is a flow chart showing the correction procedure for all of a display panel. First, in step 10, a given pixel is illuminated. Next, in step 11, luminance is captured. With a display panel made up of electron-emitting elements, it is desirable to detect the driving current or the anode current. In step 12, a correction value is calculated, and in step 13, the correction value is stored in the correction memory. The progression of steps 10–13 may be the same as that of the luminance correction operation described above. In other words, steps 10–13 may be carried out in one blanking period or only steps 10 and 11 carried out in one blanking period. Evaluation of convergence is next carried out, and it is possible to compare the captured luminance information, which is data that corresponds to a luminance value, to a given reference value (target value). This value varies according to the gain of the luminance capturing system, but it can be thought of as a value that is in some kind of relation (for example, proportionality relation or exponential relation) with the luminance value. In consideration of this, it is possible to measure the relation between the luminance value and luminance information (for example, anode current value) required in advance to set a desired target value. In step 14, the difference between captured luminance information and a given target value is calculated and it is determined whether this deviation is equal to or less than a fixed value. This evaluation is largely based on the close relationship with the acceptable range of luminance variation between adjacent pixels, and for example, when the deviation is 40 dB or less from the target value, this denotes a deviation of about 1% or less. In a case where the deviation is equal to or greater than this numerical value, the same pixel is driven again with the modified correction value. In other words, the process returns to step 10. In this manner, by repeating the correction operation, the deviation converges to a given value or less after a given number of repetitions. When the deviation of a given pixel has converged, the process advances to step 15, by which operation advances to the next pixel. In step 15, it is determined whether or not correction has been completed for all of the pixels. Supposing it has not been completed, the process returns to step 10 and the same operation is repeated. If all of the pixels have been completed, the correction operation is terminated. Thus, in all of the pixels, deviation is equal to or less than a given value, whereby luminance variation converges to a given value or less.

The luminance capturing operations for all of the pixels may be carried out successively in each video blanking period or not successively, according to arbitrary timing.

By completing such a correction procedure, the correction of luminance can be carried out on all pixels of a display panel, making it possible to suppress luminance variation.

Embodiment 5

Figure 31:
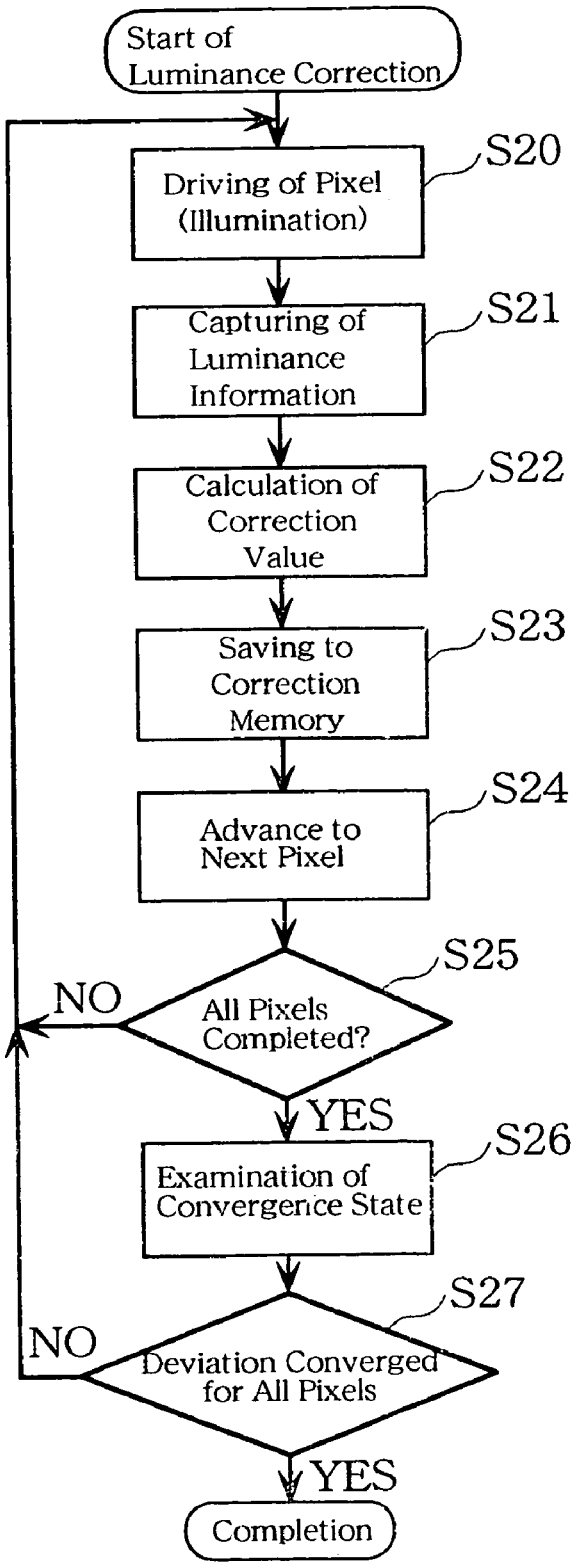
FIG. 31 is a flow chart showing a luminance correction method according to embodiment 5.

Embodiment 5 describes another example of an operation for correction of change over time. FIG. 31 is a flow chart showing the correction procedure for all of a display panel. According to this flow chart, a method is such that correction is carried out in units of the whole screen. In the previous embodiment, luminance correction was carried out until deviation converged in a specific pixel. However, with this method, depending on the conditions of convergence, there are cases where this specific pixel only lights up and this light generation is perceived. For this reason, in the present embodiment, luminance correction is carried out only once in each of the pixels that make up a single frame. This operation is repeated until all of the pixels converge.

Steps 21–23 are the same operations as those described previously. Without then carrying out an evaluation operation, operation advances to the next pixel. This is repeated until the operations of steps 20–24 have been completed for all of the pixels. Once a correction operation has been completed once for all of the pixels, the state of convergence is checked. This consists of determining the deviation between captured luminance information and a given target value, and it is acceptable that this be evaluated at the measurement stage for each pixel and that an evaluation table (not shown in figure) for every pixel be prepared. For example, in step 27, the state of convergence of each pixel is checked using the evaluation table, and if the deviation in all of the pixels has not converged, correction operation is commenced again. In this case, the process returns to step 30. At this point, regardless of the state of convergence of each pixel, correction operation may be carried out again on all of the pixels, or only on the pixels that have not converged according to the evaluation table. In step 27, if the deviations in all of the pixels have converged to a fixed value or less, correction operation is terminated.

The luminance capturing operations for all of the pixels may be carried out successively in each video blanking period or not successively, according to arbitrary timing.

By completing such a correction procedure, the correction of luminance can be carried out on all pixels of a display panel, making it possible to suppress luminance variation.

Embodiment 6

Figure 32:
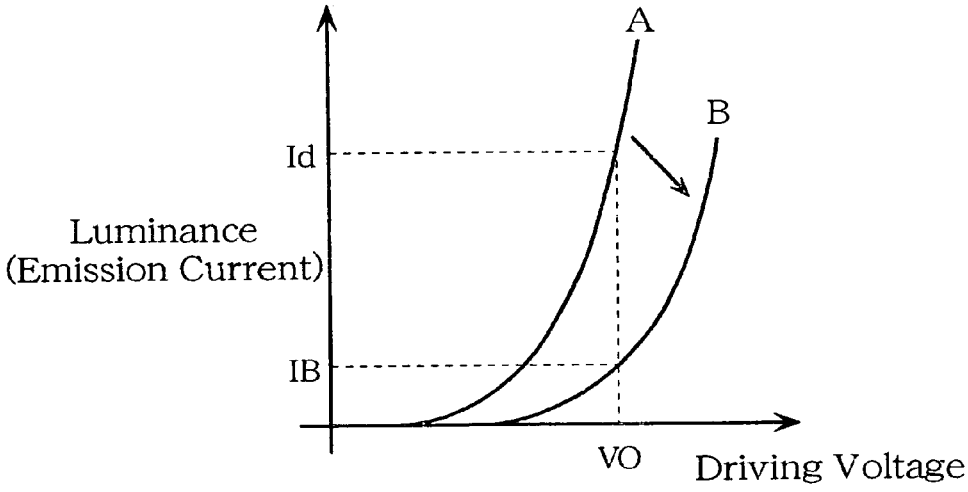
FIG. 32 is a graph for illustrating a luminance correction method according to embodiment 6 that shows the relationship between luminance current and driving voltage.
Figure 33:
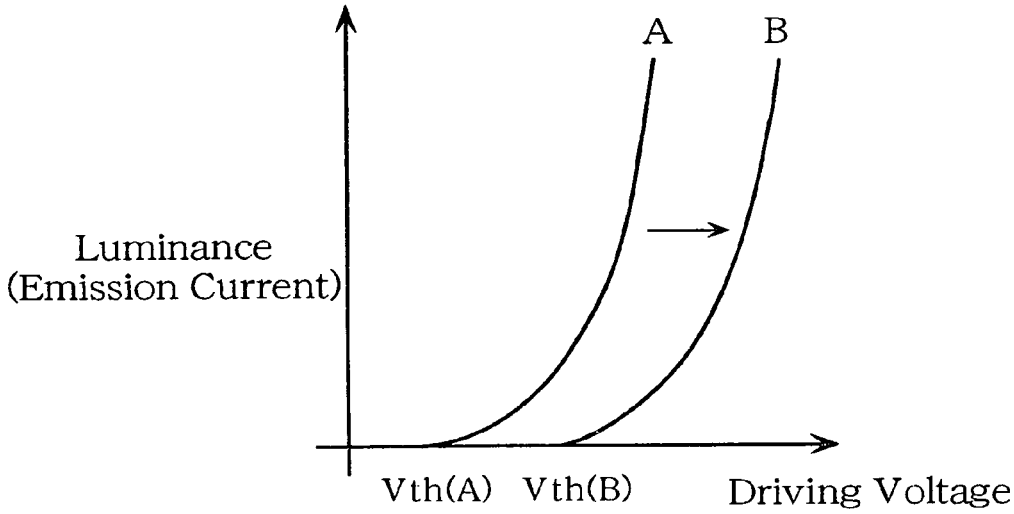
FIG. 33 is a graph for illustrating a luminance correction method according to embodiment 6 that shows the relationship between luminance current and driving voltage.

Embodiment 6 describes another example of an operation for correction of change over time. In operations for correction of change over time described hereinbefore, operation is such that a given pixel is illuminated and luminance information is captured. This is because, as is shown in FIG. 32, the luminance characteristics in the given pixel change over time. Suppose that initial characteristics as represented by curved line A change into the characteristics as represented by B after a given amount of time has elapsed. In this case, the threshold voltage and the slope of the curved line representing the characteristics has changed, making it necessary to measure luminance again before carrying out correction. In a common element, characteristics do change in the manner described above, but depending on the element, characteristics may change as shown in FIG. 33. In FIG. 33, initial characteristics are as represented by curved line A, the threshold voltage (voltage at which light begins to be emitted) being Vth (A). In this element, after a given amount of time has elapsed, the characteristics change into characteristics B. The characteristics B are merely a translation of the characteristics A, the slope of the curved line not changing as a result of a shift in only the threshold voltage to Vth (B). In an element that changes over time in this manner, in the case of carrying out luminance correction operations, it is desirable to only detect the threshold voltage. In this case, it is desirable to carry out, rather than an operation of illuminating a pixel to a given luminance and capturing luminance information as was the case in examples described hereinbefore, an operation of detecting the voltage value when a pixel begins to illuminate after having been driven, and other operations may be carried out as described hereinbefore. In other words, driving voltage is increased from the state where a pixel is not illuminated, and current is detected at the point when the pixel begins to illuminate. This current may be driving current or anode current. When the correction value is a voltage value, it is desirable to simply add to the correction value the value of the shift in the threshold voltage. In this case, the correction operation is only carried out one time per pixel, eliminating the necessity of repeating the operation. In detecting the threshold voltage, because the pixel is only illuminated the slightest bit, it is possible to carry out correction operation with absolutely no perception by the user.

In such cases where the characteristics of an element undergoes translation as a result of change over time, correction operation can be realized by simply detecting threshold voltage.

Embodiment 7

Embodiment 7 describes another example of an operation for correction of change over time. According to the correction procedures described hereinbefore, luminance information captured from every pixel is compared with a reference value (target value) that is related to target luminance to obtain correction values. This reference value is a driving control parameter (for example, driving current value, driving voltage value, driving pulse width, or the like) converted from a luminance target value, a target luminance having been set in advance.

Generally, the target value is made constant even with the elapsing of time, and even during a correction operation that adjusts for change over time, a correction value is utilized to improve the luminance of a pixel that is evaluated as having a lower luminance than this target value. In other words, a system of carrying out correction so that the luminance of all of the pixels is defined by a given constant target value is employed.

At the same time, when the degradation characteristics of elements are considered, there are cases where by carrying out control so that the luminance of the pixel whose luminance has dropped due to degradation is improved, the operating life of this specified pixel is drastically reduced. It such a case, rather than making the target value a constant value, the target value may be calculated from measured luminance information of all of the pixels and set accordingly.

For example, the smallest value of the measured luminance information from all of the pixels may be selected as the target value, in which case correction of other pixels is controlled so that luminance is reduced in these pixels.

In addition, it is conceivable that the value designated as the target value be, instead of the smallest value of the measured luminance information from all of the pixels, the largest value or an intermediate value, for example, the average value, median value, value that appears with the most frequency, or the like, and it is desirable that the value be arbitrarily set according to the characteristics of the panel.

Furthermore, in the case of images produced by CRTs or the like, the luminance of the screen as a whole decreases little by little with the elapsing of time as a result of the degradation of the phosphors and the like. However, because change in luminance applies to the screen as a whole and consists of only slight changes over time, such change is often not perceived by the human eye. In consideration of this phenomenon, it is possible to gradually lower the value as time elapses, rather than have the target value for luminance be a constant value. In other words, the target value may be defined as a function of time, and a value utilized that is reduced with the elapsing of time.

Figure 34:
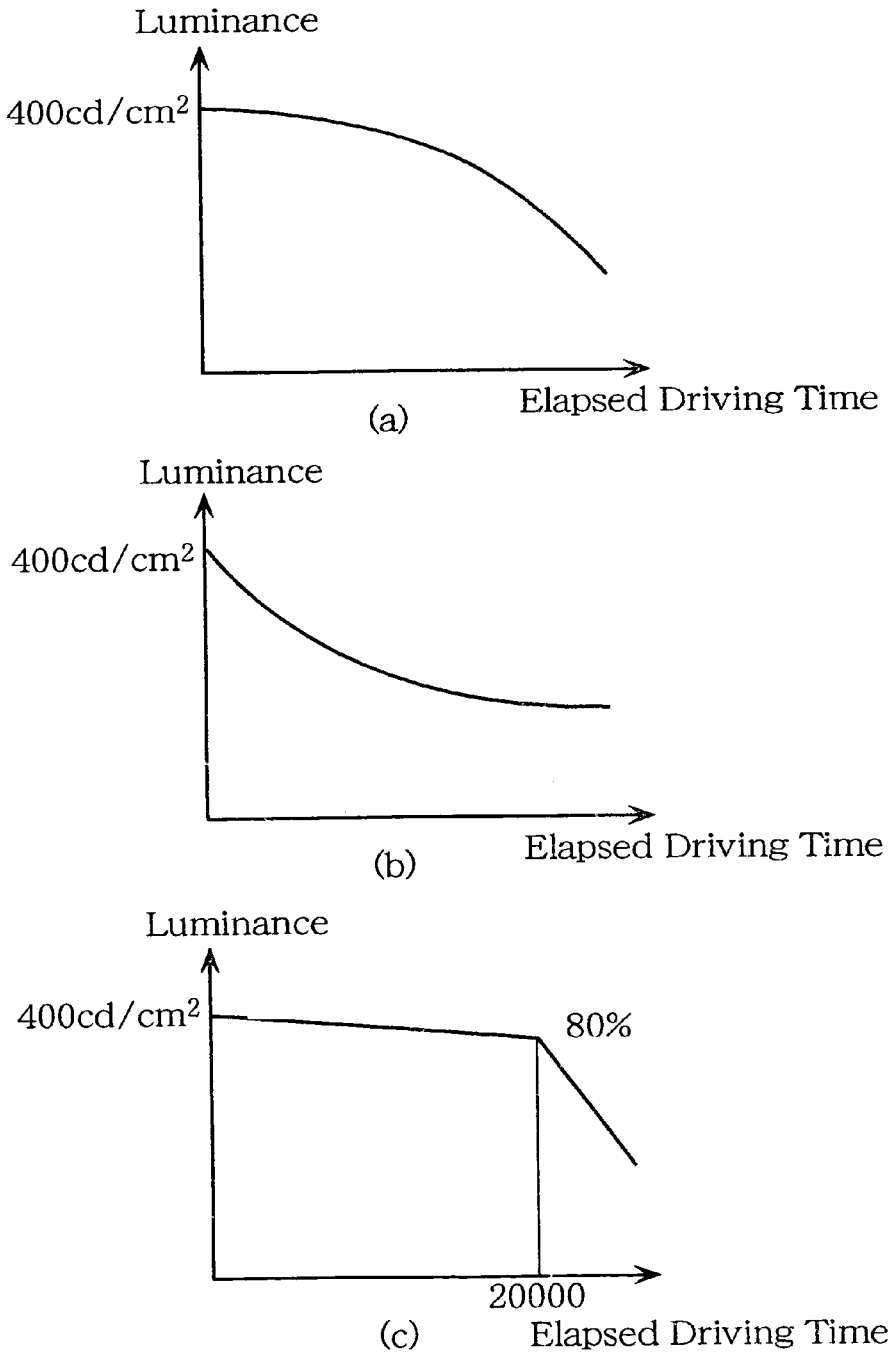
FIGS. 34(*a*), 34(*b*), and 34(*c*) are graphs for illustrating a luminance correction method according to embodiment 7 that show the degradation characteristics of phosphors.

For example, as curves that represent luminance degradation, curves such as those shown in FIGS. 34(*a*), (*b*), and (*c*) are conceivable. FIG. 34(*a*) shows characteristics such that luminance deteriorates over time, and the element characteristics are such that, as time elapses, the rate of degradation increases from that of the initial period of use. FIG. 34(*b*) also shows characteristics such that luminance deteriorates over time, but in this case, the element characteristics are such that, as time elapses, the rate of degradation decreases from that of the initial period of use. Such characteristics are typical in common elements.

The characteristics of FIG. 34(*c*), on the other hand, are represented by a curve such that luminance is maintained for a fixed period of time, after which luminance drops rapidly. According to FIG. 34(*c*), luminance decreases to only 80% of initial luminance in the first 20000 H of driving time, but after this time has elapsed, the luminance drops rapidly. The numerical values of 400 candelas, 20000 H, and 80% are only used as an example, and values are not limited to these, it being desirable to set values arbitrarily. In the case of such a change in luminance curve, it is possible to maintain a bright video image for a given fixed period of time and to guarantee quality for a fixed period. The user is then informed of the operating life of the element. Such an element has the potential for becoming an image display device that is convenient also for the user.

Figure 35:
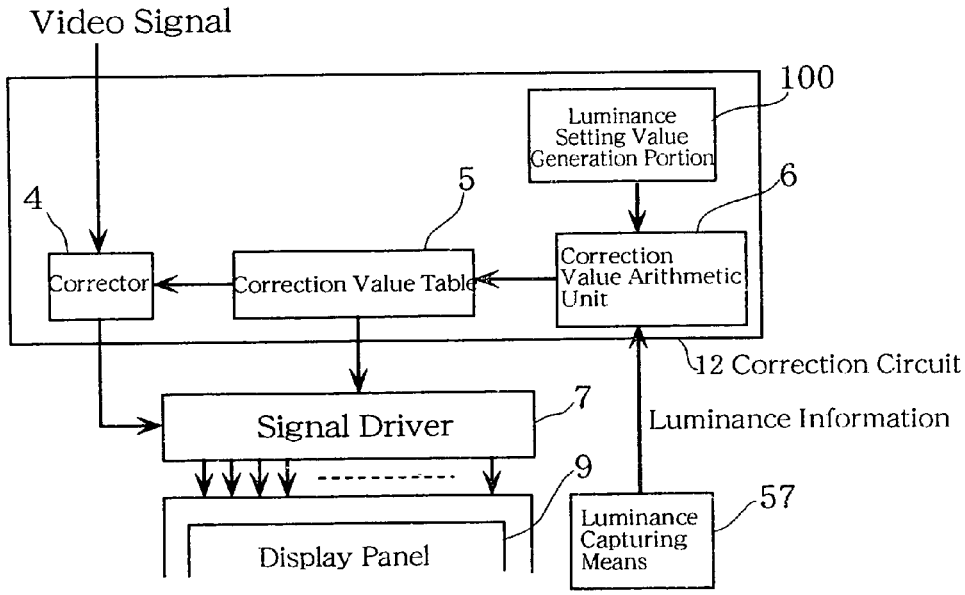
FIG. 35 is a diagram showing one example of a configuration for realizing a luminance correction method according to embodiment 7.

As for the specific configuration, it is desirable that, for example, as is shown in FIG. 35, a luminance setting device 100 be provided in the correction circuit 12 as a means for resetting luminance.

In this manner, setting a target value that is gradually reduced with time makes it possible to prevent excessive driving of each individual element, whereby the operating life of the elements and the phosphors is extended.

According to the present embodiment, the target value is gradually reduced, but there are other possibilities, characteristics being acceptable as long as the initial value is not exceeded and the target value is reduced. In addition, it is acceptable that the target value be changed with time in accordance with the characteristics of the elements.

Embodiment 8

Embodiment 8 describes another example of an operation for correction of change over time. According to the correction procedures described above, correction values are obtained from luminance information captured from every pixel. In such cases, the luminance information may be the value detected for anode current or the current of a current limiting resistor. This is defined by the number of electrons emitted from the electron-emitting elements.

Figure 36:
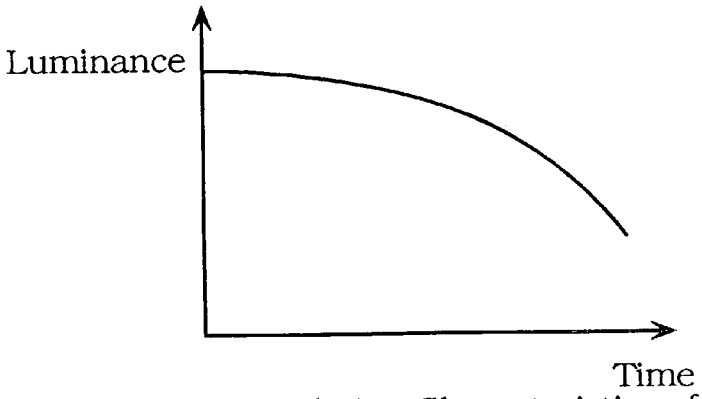
FIG. 36 is a graph showing degradation characteristics of phosphors.

Generally, when the number of electrons emitted is constant, the luminance when the phosphors emit light is constant. In actuality, however, the phosphors deteriorate with time (FIG. 36), in which case even if the same number of electrons collide with the phosphors, the emitted luminance changes (decreases).

Figure 37:
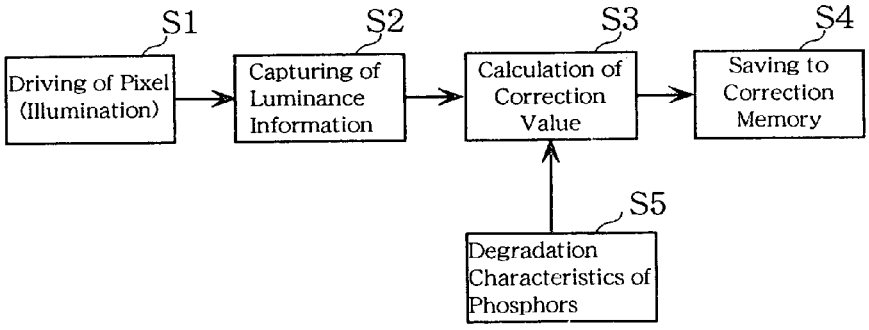
FIG. 37 is a flow chart showing a luminance correction method according to embodiment 8.
Figure 38:
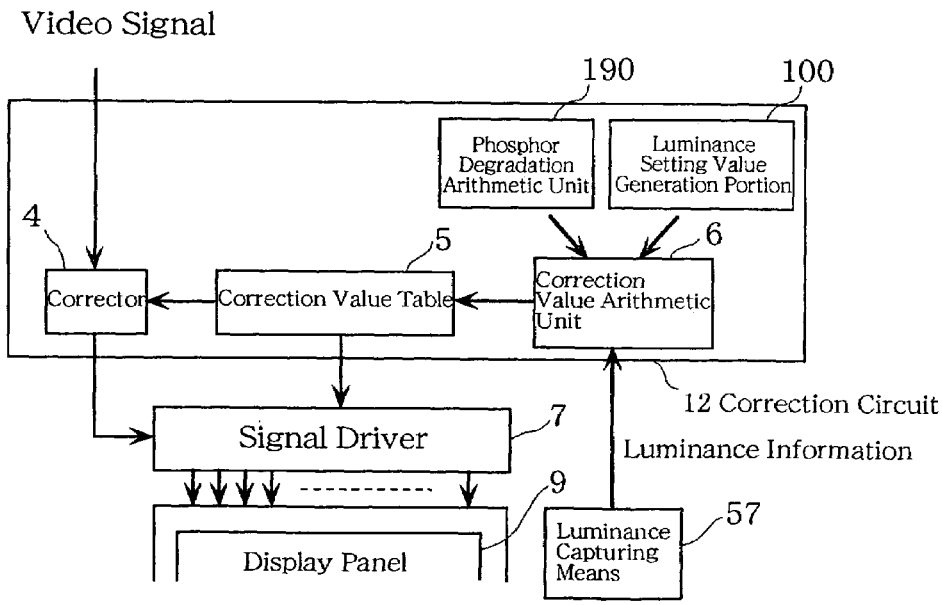
FIG. 38 is a diagram showing one example of a configuration for realizing a luminance correction method according to embodiment 8.

FIG. 37 shows a correction operation procedure that takes into consideration the degradation of phosphors. Steps 1 to 4 correspond to the correction procedures described hereinbefore. This procedure differs in that in step 5, a value related to the luminance degradation of the phosphors is calculated, and in step 3, in which correction values are calculated, the calculation of a correction value is carried out using both the value of captured luminance information and the value related to the luminance degradation of the phosphors. The process of step 5 may be carried out by, for example, a phosphor degradation arithmetic unit 190 shown in FIG. 38.

The process of step 5 will now be described. First, the value related to luminance degradation of the phosphors will be described. The degradation of the phosphors with time can be estimated using the value for accelerating voltage in the direction toward the phosphors and the time integral of the collision current amount. For example, when the accelerating voltage is constant, the luminance degradation characteristics of the phosphors may be represented by the time function of collision current amount. When a luminance degradation coefficient is taken to be the numerical value for the rate of degradation, it is represented by a function that decreases with time from an initial value of 1.0. This luminance degradation coefficient may be expressed as a mathematical expression or may be expressed in the form of a lookup table with respect to time.

Alternatively, it is possible to integrate the current amount that is supplied to each pixel where correction is to be carried out. Of the systems of driving described hereinbefore, consider the case of, for example, carrying out amplitude control. In this case, in a given driving period, the amplitude value (current amount) is made constant, pulse width is controlled according to a given gray scale command value, and the element is driven. The current amount emitted is proportional to time. For example, it is thought that integration of the information for pulse width results in a value equivalent to the time integral amount of the number of electrons that collide into the phosphors in a given pixel. By storing this integral amount in an integral table for each of the pixels, time integral information for current is stored.

In the correction operation of the pixels, it is possible to obtain a luminance degradation correction coefficient for that time from the time integral information of that point in time. For example, suppose that at the time of correction 100 hours have elapsed and that at this time the time integral information is 10 hours and 30 minutes. Suppose that the luminance degradation correction coefficient at this time is, for example, 0.98. Luminance at the point where a pixel has been driven by a calculated correction value and illuminated is multiplied by a coefficient that is the inverse of the luminance degradation correction coefficient. Specifically, in the case of pulse width control, because pulse width is proportional to luminance, the calculated correction value (in this case, the value for pulse width itself) is multiplied by the inverse of this luminance degradation correction coefficient (in this case, 0.98). In cases of a system of driving where the correction value and the luminance are not proportional, the luminance correction coefficient is recalculated. In addition, the luminance degradation correction coefficient may be such that correction is carried out, not only by multiplication with the inverse, but be carried out in accordance to the characteristics of elements and the system of driving utilizing addition, subtraction, differentiation, or the like.

As described above, renewing correction values again taking the luminance degradation characteristics of phosphors into consideration makes luminance correction that takes into account the degradation of phosphors possible. Thus, a more accurate correction operation for change over time is made possible.

Note that when outputting an average video or the like, the time integral information may be substituted with only the driving time of the panel in cases where there is no variation in the time integral amount of the number of electrons that collide into the phosphors, where preparation of an integral amount table for all of the pixels results in an increase in cost, or the like.

In addition, in cases where the luminance degradation characteristics differ according to the color emitted from the phosphors, a luminance degradation correction coefficient may be prepared for each of R, G, and B.

Although a collision current component value was used as the parameter for phosphor degradation, the possibilities are not limited to this, it being acceptable to use an amount that can be an estimate of the rate of degradation.

By completing such a correction procedure, the correction of luminance can be carried out on all of the pixels of a display panel, making it possible to suppress luminance variation.

Embodiment 9

Figure 39:
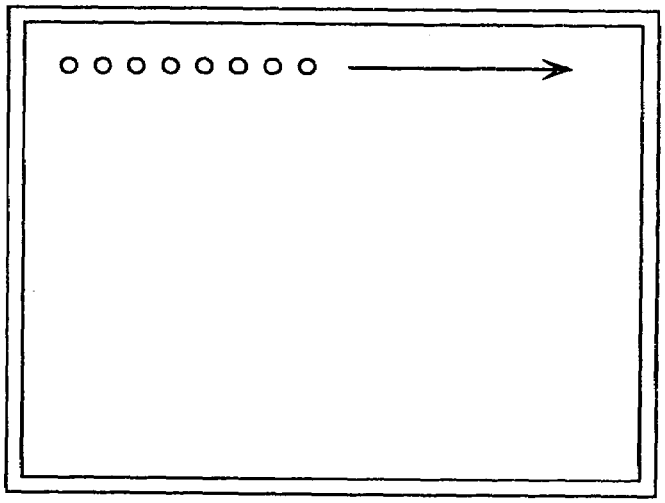
FIG. 39 is a diagram showing a luminance correction method according to embodiment 9.

Embodiment 9 describes another example of an operation for correction of change over time. In the correction procedures described hereinbefore, the order in which correction operations are carried out on the pixels is as shown in the schematic views of FIGS. 39 and 40. FIG. 39 shows a method by which the carrying out of luminance correction moves successively from pixel to adjacent pixel. This order is the same as that of the system of video output employed by a common CRT. With this system, operation need only be carried out in order, making for a simple configuration.

Figure 40:
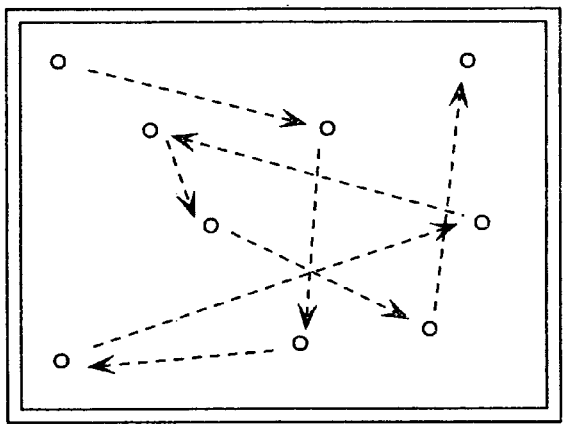
FIG. 40 is as diagram showing a luminance correction method according to embodiment 9.

When operation is such that adjacent pixels are corrected successively, even though the period of illumination is short, the illumination is linear and depending on the timing, the illumination is sometimes perceived as a line. In such cases, rather than successively selecting adjacent pixels, as shown in FIG. 40, pixels that are not adjacent may be arbitrarily selected. By carrying out correction in this manner, possibility that the luminance correction operation be perceived is eliminated.

Embodiment 10

Figure 41:
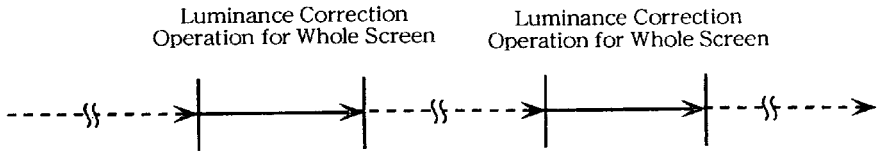
FIG. 41 is a diagram showing a luminance correction method according to embodiment 10.

Embodiment 10 describes another example of an operation for correction of change over time. FIG. 41 shows an example of the operation intervals between luminance correction operations. According to operations such as those described in the embodiments above, when carrying out luminance correction, recorrection is carried out at given intervals. The intervals between the recorrection operations are arbitrarily determined according to element characteristics. In the present invention, because luminance correction operations that are not perceived by the user are possible, any interval between corrections is acceptable. For example, correction may be carried out at regular intervals of 1000 hours.

Figure 42:
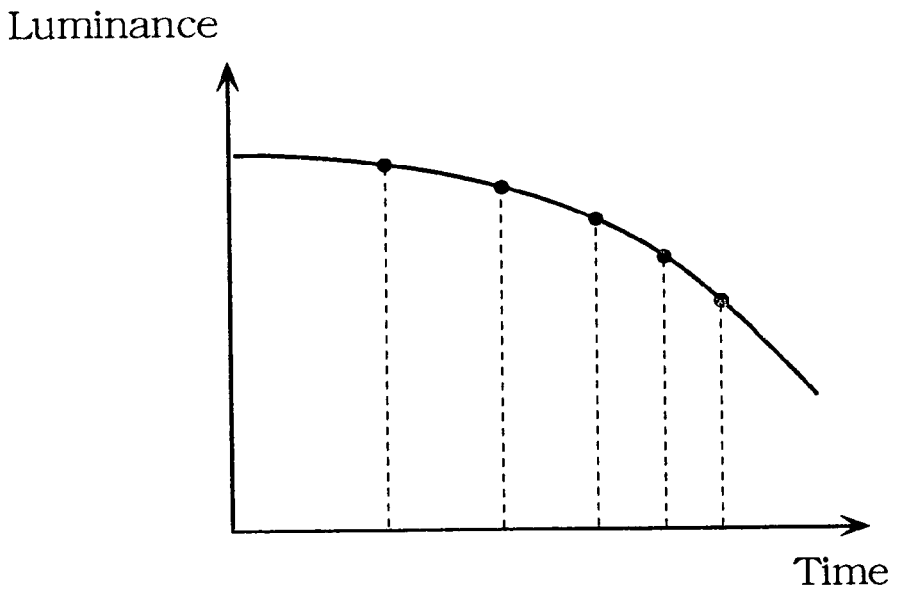
FIG. 42 is a graph showing operating life characteristics of elements that make up a display panel.

FIG. 42 shows the characteristics of the operating life of elements that make up a display panel. Luminance deteriorates over time, and element characteristics are such that, as time elapses, the rate of degradation increases from that of the initial period of use. In the case of a display panel having such characteristics, supposing the intervals between luminance corrections are set to be on the long side at first, and as time elapses, the intervals are shortened, suppression of luminance variation to a minimum is made possible.

Figure 43:
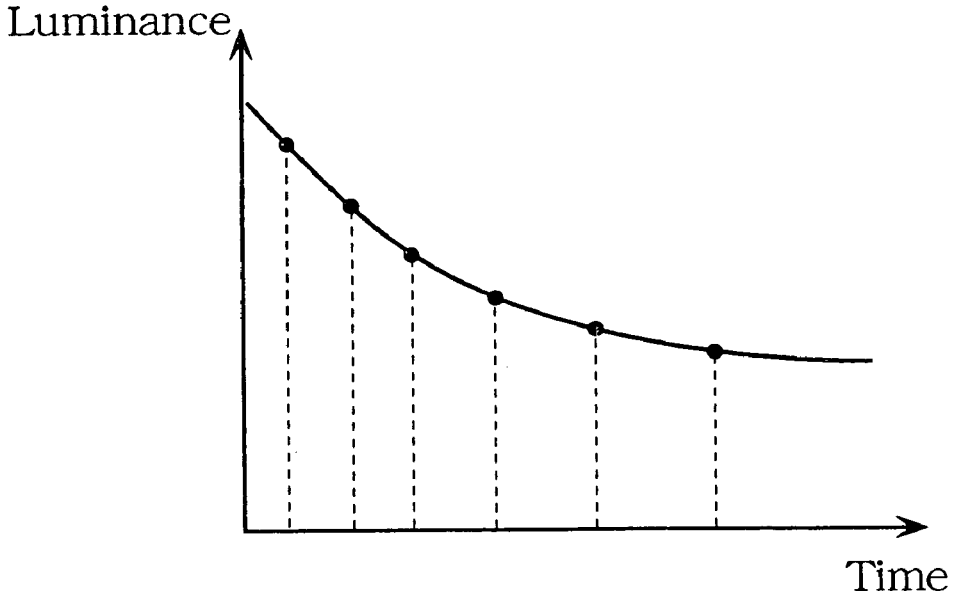
FIG. 43 is a graph showing operating life characteristics of elements that make up a display panel.

In addition, FIG. 43 shows the characteristics of the operating life of elements that make up a display panel. These characteristics also are such that luminance deteriorates over time, but the element characteristics are such that, as time elapses, the rate of degradation decreases from that of the initial period of use. In this case, supposing the intervals between luminance corrections is set to a short length at first, and as time elapses, the intervals are lengthened, suppression of luminance variation to a minimum is made possible.

The intervals between luminance correction operations may be regular intervals, or as described above, even by setting the intervals between repetitions of correction operations according to element characteristics, it is possible to suppress luminance variation to a minimum and to correct luminance variation without perception by the user.

Figure 44:
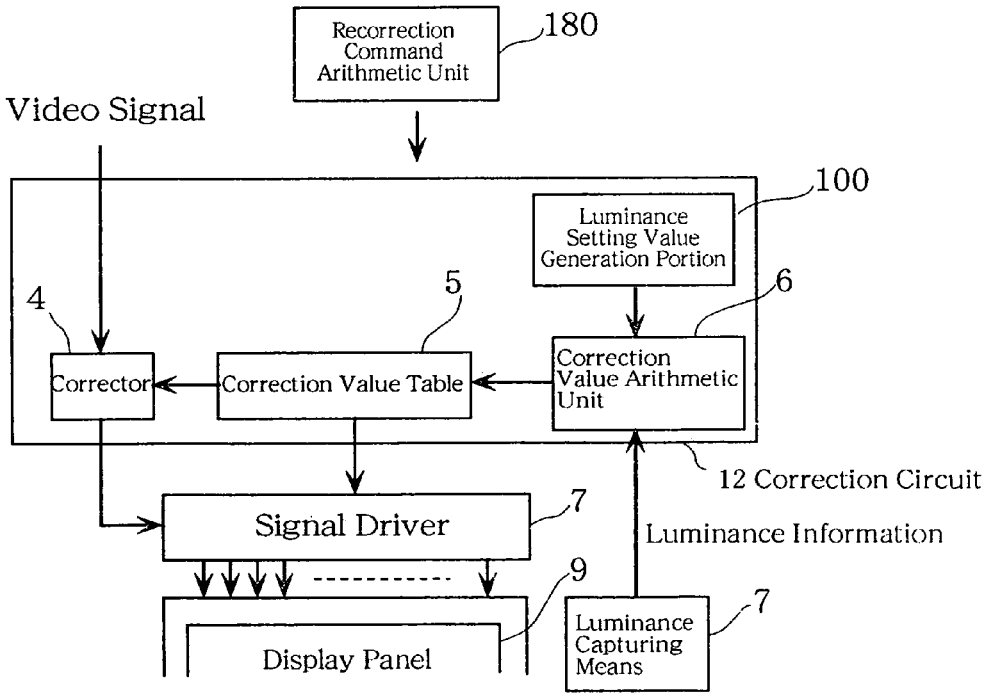
FIG. 44 is a diagram showing one example of a configuration for realizing a luminance correction method according to embodiment 10.

As for the specific configuration for varying the intervals of luminance correction, it is desirable that the correction be carried out by, for example, a recorrection command arithmetic unit 180 as is shown in FIG. 44.

Embodiment 11

Figure 45:
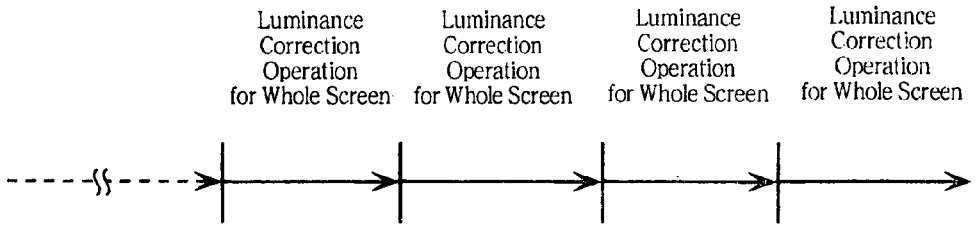
FIG. 45 is a diagram showing a luminance correction method according to embodiment 11.
Figure 46:
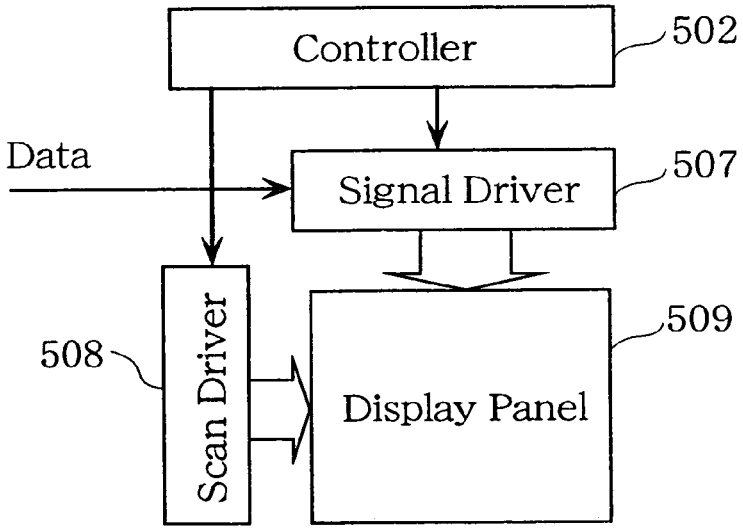
FIG. 46 is a diagram showing the configuration of a conventional basic display
Figure 47:
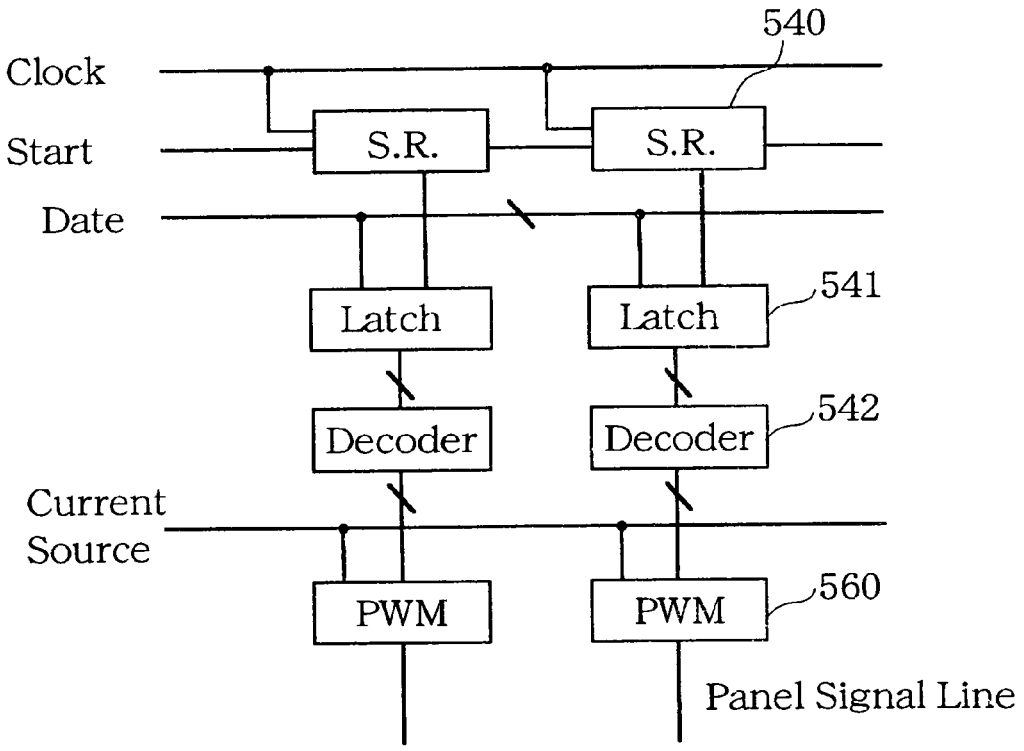
FIG. 47 is a diagram showing the configuration of a conventional system of PWM.
Figure 48:
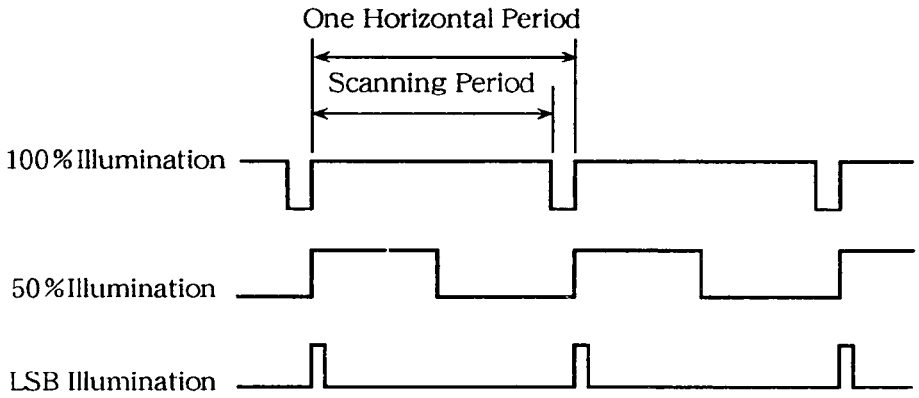
FIG. 48 is a diagram showing one example of an illumination pattern of a conventional system of PWM.
Figure 49:
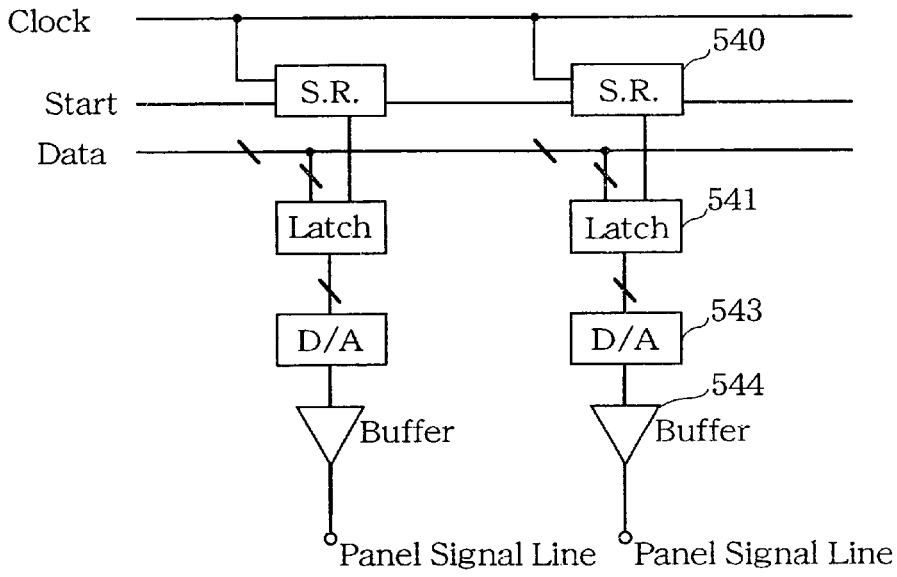
FIG. 49 is a diagram showing the configuration of a conventional system of output modulation.
Figure 50:
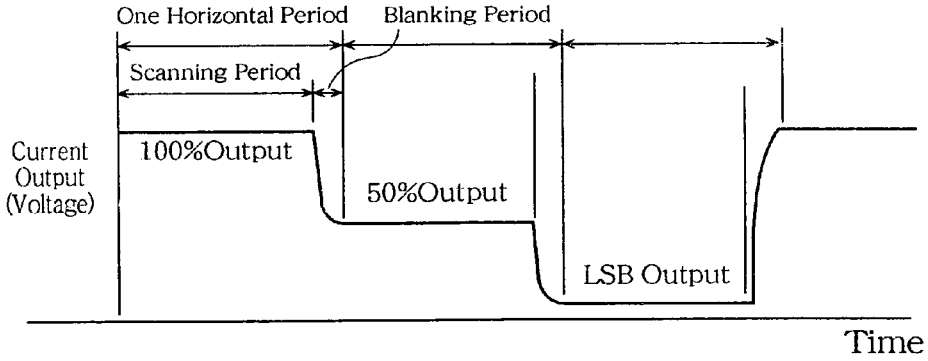
FIG. 50 is a diagram showing one example of an illumination pattern of a conventional system of output modulation.

Embodiment 11 describes another example of an operation for correction of change over time. FIG. 45 shows an example of the operation intervals between luminance correction operations. In the present embodiment, luminance correction operations for the whole screen are carried out successively. In the embodiments described hereinbefore, recorrection was carried out at given intervals, though because an advantage of the present invention is the carrying out of luminance correction during blanking periods, it is possible to carry out the operations without perception by the user. For this reason, it is possible to carry out correction of all of the pixels successively without any breaks of a given duration. In such a case, correction is constantly being performed, making a display with no luminance variation possible, regardless of the rate of luminance degradation.

Luminance correction operations for the whole screen are carried out successively, but with such operations, the operations of capturing luminance from each pixel may be carried out successively during every video blanking period or may be carried out not successively, according to arbitrary timing.

It should be noted that the luminance utilized in the embodiments described hereinbefore is, in all cases, a luminance measured from the front of a panel. Depending on the conditions, however, a luminance that not measured from the front of a panel may be utilized so long as usage is consistent.

According to the embodiments, given pixels of a display panel are illuminated and luminance information (for example, driving current or in an FED, anode current) captured, a correction value memory is created, and driving is corrected according to this correction memory, thereby making it possible to realize a display without non-uniformity in illumination with respect to both initial characteristics and change over time.

By capturing luminance information from pixels and renewing the correction memory based on this luminance information during the video idle periods, it is possible to correct for change over time without interrupting video output. Correction operation of which the user is not aware is thus possible, and a display panel that maintains high display quality can be provided.

Supplementary Remarks (1) In order to realize the systems of gray scale driving and luminance correction described hereinbefore, it is generally possible to use a driver-IC. In this case, the arithmetic circuit for calculating correction values, the correction value memory, the corrector, the signal driver, and the like may be built into one chip. With such circuits, any arrangement of the circuits is possible in the one chip, it being possible to determine the arrangement according to use.

(2) In the driver IC for realizing gray scale, a configuration is conceivable in which a correction memory is provided to carry out correction. By thus building a functional block into one chip, the cost of the driver is reduced contributing to an overall reduction in cost, and size and weight of the device is reduced.

(3) With an image display device having a display panel, a gray scale driving circuit, and a luminance correction circuit, which carry out the operations described in the embodiments, it is possible to provide a high quality image display device that, in addition to accurately realizing gray scale, suppresses luminance variation in the initial stages and with change over time and that realizes a reduction in size and weight.

(4) With a light source having a gray scale driving circuit and a luminance correction circuit, which carry out the operations described in the embodiments, it is possible to change the luminance setting and thus, while a suitable luminance is obtained, the strain on the elements is reduced and operating life extended.

INDUSTRIAL APPLICABILITY

As has been described, the configuration of the present invention makes it possible to realize a display without non-uniformity in illumination typically caused by change over time. Specifically, the invention is as follows.

(1) By changing a luminance setting reference value with the elapsing of time, strain on elements is alleviated and operating life thereby extended.

(2) By changing renewal intervals for correction memory in accordance with the characteristics of luminance degradation, recorrection at optimum intervals is made possible without relying on luminance measurement and evaluation.

(3) In a device having phosphors, by considering the degradation characteristics of the phosphors in carrying out luminance correction, the accuracy of luminance correction is improved.

(4) By carrying out a correction operation (driving of pixel and capturing of luminance information) within a period that does not affect video signal output, the need to interrupt video display during use is eliminated.

(5) Gray scale is realized in particular by a system of carrying out amplitude control and pulse width control simultaneously, by a system of changing amplitude value in the direction of increase in order to display gray scale, by control of switching between systems of gray scale, and the like. Realization of high gray scale resolution and output of high quality images is thereby made possible.

What is claimed is:

1. A method of driving a display panel, comprising:

setting a pixel luminance value to a target luminance setting value at least two times at predetermined time intervals; and carrying out luminance value setting operations such that a luminance setting value is set to a different luminance setting value each time a luminance value setting operation is preformed, so that the luminance setting value is changed with the elapse of driving time, wherein the luminance setting values are determined from measured luminance information of the pixels during successive video blanking periods.

2. The method of driving a display panel according to claim 1, wherein said pixel luminance value is corrected to match the determined luminance setting values.

3. The method of driving a display panel according to claim 2, wherein the operations for correcting luminance setting values are carried out during periods other than video output periods.

4. The method of driving a display panel according to claim 2, wherein until the difference between the measured luminance information and the luminance setting value reaches a fixed value or less, correction operations are repeated continuously.

5. The method of driving a display panel according to claim 1, wherein each of the luminance setting values does not exceed a preceding luminance setting value.

6. A method of driving a display panel, comprising:

setting a pixel luminance value to a target luminance setting value at least three times at predetermined time intervals with a luminance setting value determined from measured luminance information of pixels during successive video blanking periods; and carrying out luminance correcting operations such that each of the time intervals between the luminance correction operations differ, whereby the starting interval of recorrection operation is varied, wherein the intervals between the luminance correction operations are varied according to the luminance degradation characteristics of display elements.

7. A method of driving a display panel wherein pixels are driven, luminance information is captured from the pixels and measured, correction values are calculated from the measured luminance information and a luminance setting value, the correction values are stored in a correction memory, and a driving amount is corrected in accordance with the correction memory, the method comprising:

carrying out a series of renewal operations on the correction memory for all of the pixels at least two times at predetermined time intervals, wherein the luminance setting value is determined from measured luminance information of the pixels during successive video blanking periods.

8. The method of driving a display panel according to claim 7, wherein the series of renewal operations on the correction memory, instead of being carried out at specified time intervals, is repeated continuously.

9. A method of driving a display panel wherein pixels are driven, luminance information is captured from the pixels and measured, correction values are calculated from the measured luminance information and a luminance setting value, the correction values are stored in a correction memory, and a driving amount is corrected in accordance with the correction memory, the method comprising:

setting pixel luminance value to a target luminance setting value at least two times at predetermined time intervals; and carrying out luminance setting operations such that a luminance setting value is set to a different luminance setting value each time a luminance setting value operation is performed, so that the luminance setting value is changed with the elapse of driving time, wherein the luminance setting value is determined from measured luminance information of the pixels during successive video blanking periods, the measured luminance information acquired by an array of anodes in the display panel positioned over the pixels.

10. The method of driving a display panel according to claim 9, wherein capturing luminance information from the pixels comprise at least illuminating the pixels during periods other than video output periods.

11. The method of driving a display panel according to claim 10, wherein the periods other than video output periods are vertical blanking periods, and luminance information from a given number of grouped pixels is captured during each of these periods.

12. The method of driving a display panel according to claim 10, wherein adjacent pixels are not successively driven.

13. The method of driving a display panel according to claim 9, wherein the correction value calculations are carried out using both measured luminance information and degradation characteristics related to either the luminance of elements for which luminance has been measured or to the luminance of pixels for which luminance has been measured.

14. The method of driving a display panel according to claim 13, wherein the display panel has a light-emitting surface with phosphors, and the correction value calculations are carried out using both measured luminance information and degradation characteristics related to the luminance of the phosphors.

15. The method of driving a display panel according to claim 13, wherein the degradation characteristics are measured in advance, rates of degradation are calculated based on the driving integral amount of every pixel, correction values are calculated using both the measured luminance information and the rates of degradation, and the correction memory is renewed.

16. The method of driving a display panel according to claim 9, wherein the captured luminance information is driving current.

17. The method of driving a display panel according to claim 9, wherein the captured luminance information is that of the starting point of the illumination of pixels.

18. The method of driving a display panel according to claim 9, wherein the display panel has at least an anode electrode and a light-emitting surface having a plurality of phosphors on the anode electrode, and the captured luminance information is anode current.

19. The method of driving a display panel according to claim 9, wherein input luminance signals are corrected in accordance with the correction values stored in the correction memory.

20. The method of driving a display panel according to claim 9, wherein the amplitude value or the pulse width of driving signals applied to the display panel is corrected in accordance with the correction values stored in the correction memory.

21. The method of driving a display panel according to claim 9, wherein the correction values are calculated so as to incorporate data for γ correction for each pixel and stored to the correction memory.

22. The method of driving a display panel according to claim 9, wherein a gray scale realization method for the display panel is either an amplitude control method or pulse width control method.

23. The method of driving a display panel according to claim 9, wherein a gray scale realization method for the display panel is a gray scale system such that except when an output is completed, a current or voltage value for amplitude control is changed only in an increasing direction.

24. The method of driving a display panel according to claim 9, wherein a gray scale realization method for the display panel is a driving system such that amplitude control and pulse width control are carried out simultaneously.

25. The method of driving a display panel according to claim 24, wherein for the gray scale control, the amplitude control is such that using m high-order bits of gray scale data represented by n bits, where m and n are arbitrary positive integers, a current or voltage value controlled by amplitude is outputted at intervals of $1/2^m$ maximum value and the pulse width control is such that using (n-m) low-order bits, pulse width is controlled at intervals of $1/2^{(n-m)}$ maximum value.

26. The method of driving a display panel according to claim 24, wherein the LSB of current or voltage value output is outputted twice, or the LSB or output pulse width is outputted twice, or the LSB of both are outputted twice.

27. The method of driving a display panel according to claim 24, wherein the number of divisions of output for pulse width control is greater than the number of divisions of output for amplitude control.

28. The method of driving a display panel according to claim 9, wherein a gray scale realization method of the display panel is a driving method for realizing gray scale display comprising switching between amplitude control or pulse width control and a system of gray scale control in which amplitude control and pulse width control are carried out simultaneously.

29. The method of driving a display panel according to claim 28, wherein, when the luminance signal level to be outputted is equal to or less than a reference value, amplitude control or pulse width control is carried out, and when equal to or greater than a reference value, the system of gray scale control where amplitude control and pulse width control are carried out simultaneously is carried out to realize gray scale display.

30. The method of driving a display panel according to claim 29, wherein the reference value is a number of output gray scale levels and is set to be the number of gray scale levels on the pulse width control side in the system of gray scale control where amplitude control and pulse width control are carried out simultaneously.

31. The method of driving a display panel according to claim 28, wherein the gray scale realization system is switched according to time to realize gray scale display.

32. A luminance correction device, comprising luminance target means for setting pixel luminance to a target luminance setting value at least two times at predetermined time intervals, and luminance resetting means for carrying out luminance setting operations such that a luminance setting value is set to a different luminance setting value each time, and wherein the luminance setting value is changed with the elapse of driving time, and further comprising:

luminance determining means for determining the luminance setting value from measured luminance information of the pixels, wherein the luminance setting value is determined from measured luminance information of the pixels during successive video blanking periods.

33. The luminance correction device according to claim 32, further comprising luminance correcting means for correcting pixel luminance to match the luminance setting value.

34. The luminance correction device according to claim 33, wherein the operations for correcting luminance setting values are carried out during periods other than video output periods.

35. The luminance correction device for a display panel according to claim 33, further comprising controlling means for controlling the correction operations so that until the difference between the measured luminance information and the luminance setting value reaches a fixed value or less, the correction operations are repeated continuously.

36. The luminance correction device according to claim 32, wherein each of the luminance setting values does not exceed a preceding luminance setting value.

37. A luminance correction device for a display panel, comprising:

luminance target means for setting pixel luminance to a target luminance setting value at least two times at predetermined intervals;

luminance resetting means for carrying out luminance setting operations such that a luminance setting value is set to a different luminance setting value each time;

driving means for driving pixels;

luminance measuring means for capturing luminance information from the pixels, wherein the luminance setting value is determined from the measured luminance information of the pixels during successive video blanking periods;

a correction memory for storing correction values;

calculating means for calculating correction values from the measured luminance information and the luminance setting value and storing the correction values to the correction memory, and correcting means for correcting a driving amount in accordance with the correction memory;

wherein each of the luminance setting values does not exceed a preceding luminance setting value.

38. The luminance correction device for a display panel according to claim 37, wherein said calculating means for calculating correction values uses both the measured luminance information and degradation characteristics related to either the luminance of elements for which luminance has been measured or to the luminance of pixels for which luminance has been measured and for renewing a correction memory.

39. The luminance correction device for a display panel according to claim 38, wherein the display panel has a light-emitting surface of phosphors, and wherein the calculation correcting means is such that, the correction value calculations are carried out using both the measured luminance information and degradation characteristics related to the luminance of the phosphors.

40. The luminance correction device for a display panel according to claim 38, wherein the calculation correcting means is such that the degradation characteristics are measured in advance, rates of degradation are calculated based on the rates on the driving integral of driving current for every pixel, correction values are calculated using both the measured luminance information and the rates of degradation, and the correction memory is renewed.

41. The luminance correction device for a display panel according to claim 37, wherein the luminance measuring means is such that the captured luminance information is driving current.

42. The luminance correction device for a display panel according to claim 37, wherein the luminance measuring means is such that the capturing luminance information is that of the starting point of the illumination of pixels.

43. The luminance correction device for a display panel of claim 37, wherein the display panel has at least an anode electrode and a light-emitting surface having a plurality of phosphors on the anode electrode, and the captured luminance information is anode current.

44. The luminance correction device for a display panel of claim 37, comprising:

controlling means for, in the initial stage after fabrication of the panel, illuminating all of the pixels in the panel one at a time, capturing luminance information from the pixels, calculating correction values from the luminance information and a luminance setting value, and storing the correction values to a correction memory as initial correction values.

45. The luminance correction device for a display panel according to claim 37, wherein the correcting means for correcting a driving amount in accordance with correction values stored in a correction memory is for correcting input luminance signals.

46. The luminance correction device for a display panel according to claim 37, wherein the correcting means for correcting a driving amount in accordance with correction values stored in a correction memory is for correcting the amplitude or the pulse width of driving signals applied to the display panel in accordance with the correction values stored in the correction memory.

47. The luminance correction device for a display panel according to claim 37, wherein a gray scale realization method for the display panel is an amplitude control method or pulse width control method.

48. The luminance correction device for a display panel according to claim 47, wherein a correction memory has, for each pixel, a number of values equal to the number of levels of amplitude value.

49. The luminance correction device for a display panel according to claim 47, wherein the correction memory has, for each pixel, values that incorporate data for γ correction.

50. The luminance correction device for a display panel according to claim 37, wherein a gray scale realization method for the display panel is a system of gray scale display such that except when an output is completed, a current or voltage value for amplitude control is changed only in the direction of increase.

51. The luminance correction device for a display panel according to claim 37, wherein a gray scale realization method of the display panel is a driving system such that amplitude control and pulse width control are carried out simultaneously.

52. The luminance correction device for a display panel according to claim 51, wherein for the gray scale control, the amplitude control is such that using m high-order bits of gray scale data represented by n bits, where m and n are arbitrary positive integers, a current or voltage value controlled by amplitude is outputted at intervals of $1/2^m$ maximum value and the pulse width control is such that using (n-m) low-order bits, pulse width is controlled at intervals of $1/2^{(n-m)}$ maximum value.

53. The luminance correction device for a display panel according to claim 51, wherein the LSB of current or voltage value output is outputted twice, or the LSB or output pulse width is outputted twice, or the LSB of both are outputted twice.

54. The luminance correction device for a display panel according to claim 51, wherein the number of divisions of output for pulse width control is greater than the number of divisions of output for amplitude control.

55. The luminance correction device for a display panel of claim 37, wherein a gray scale realization method of the display panel is a driving method for realizing gray scale display comprising switching between amplitude control or pulse width control and a system of gray scale control in which amplitude control and pulse width control are carried out simultaneously.

56. The luminance correction device for a display panel according to claim 55, further comprising means for realizing gray scale by, when the luminance signal level to be outputted is equal to or less than a reference value, carrying out amplitude control or pulse width control, and when equal to or greater than a reference value, carrying out the system of gray scale control where amplitude control and pulse width control are carried out simultaneously.

57. The luminance correction device for a display panel according to claim 56, wherein the reference value is a number of output gray scale levels and is set to be the number of gray scale levels on the pulse width control side in the system of gray scale control where amplitude control and pulse width control are carried out simultaneously.

58. The luminance correction device for a display panel according to claim 55, further comprising a means for realizing gray scale by switching the gray scale realization system according to time.

59. The luminance correction device for a display panel according to claim 37, and wherein at least two of the correction memory, the correcting means, the calculating means, and the controlling means are combined.

60. A luminance correction device, comprising luminance target means for setting pixel luminance to a target luminance setting value at least three times at predetermined intervals with a luminance setting value determined from measured luminance information of the pixels during successive video blanking periods, and luminance correcting means for carrying out luminance correcting operations such that each of the time intervals between the luminance correction operations differ, and wherein the starting interval of recorrection operation is varied, wherein the intervals between the luminance correction operations are varied according to luminance degradation characteristics of display elements.

61. The luminance correction device according to claim 60, wherein the intervals between the luminance correction operations are varied according to luminance degradation characteristics of display elements.

62. A luminance correction device for a display panel, comprising driving means for driving pixels, luminance measuring means for measuring luminance information from the pixels, a correction memory for storing correction values, calculating means for calculating correction values from measured luminance information and a luminance setting value and storing the correction values to the correction memory, correcting means for correcting a driving amount in accordance with the correction memory, and controlling means for carrying out a series of renewal operations on the correction memory for all of the pixels at least two times at predetermined time intervals, wherein the luminance setting value is determined from measured luminance information of the pixels during successive video blanking periods.

63. The luminance correction device for a display panel according to claim 62, wherein the controlling means is such that the series of renewal operations on the correction memory, instead of being carried out at specified time intervals, is repeated continuously.

64. The luminance correction device for a display panel according to claim 62, further comprising controlling means for controlling the capture of luminance information from the pixels so that at least the pixels are illuminated during periods other than video output periods.

65. The luminance correction device for a display panel according to claim 64, wherein the periods other than video output periods are vertical blanking periods, and luminance information from a given number of grouped pixels is captured during each of these periods.

66. The luminance correction device for a display panel according to claim 64, wherein the controlling means is such that adjacent pixels are not successively illuminated.

* * * * *